United States Patent [19]

Dunn et al.

[11] 3,975,587

[45] Aug. 17, 1976

[54] DIGITAL VOCODER

[75] Inventors: James Grant Dunn, Montclair, N.J.; John Richard Cowan, Brooklyn; Anthony Joseph Russo, Richmond Hills, both of N.Y.

[73] Assignee: International Telephone and Telegraph Corporation, Nutley, N.J.

[22] Filed: Sept. 13, 1974

[21] Appl. No.: 505,808

[52] U.S. Cl. ..... 179/1 SA

[51] Int. Cl.[2] ..... G10L 1/00

[58] Field of Search ..... 179/1 SA, 1 SC

[56] References Cited

UNITED STATES PATENTS

| | | | |
|---|---|---|---|
| 3,327,058 | 6/1967 | Coker | 179/1 SA |
| 3,471,648 | 10/1969 | Miller | 177/1 SA |
| 3,624,302 | 11/1971 | Atal | 179/1 SA |
| 3,631,520 | 12/1971 | Atal | 179/1 SA |
| 3,715,512 | 2/1973 | Kelly | 179/1 SA |
| 3,746,791 | 7/1973 | Wolf | 179/1 SA |
| 3,750,024 | 7/1973 | Dunn | 179/1 SA |

OTHER PUBLICATIONS

Itakura, Saito, "Digital Filtering . . . " Seventh Int'l Congress on Accoustics, Budapest, 1971.

*Primary Examiner*—Kathleen H. Claffy
*Assistant Examiner*—E. S. Kemeny
*Attorney, Agent, or Firm*—John T. O'Halloran; Peter C. Van Der Sluys; Alfred C. Hill

[57] ABSTRACT

This invention relates to a digital vocoder where speech is translated to a digital version thereof. An adaptive filter in the form of an N stage Itakura type cascade derives from the speech a prediction residual and N spectral parameter in the form of weighting coefficients of the filter. The pitch period, derived from the prediction residual, the voiced/unvoiced decision derived from the first of the weighting coefficients and the peak amplitude of a pitch pulse, and a digital signal representing filter gain, derived from the last of the weighting coefficients are multiplexed with each other and the N spectral parameters for transmission to a receiver. The receiver employs an excitation generator responsive to the pitch period, the gain signal and the voiced/unvoiced decision to produce an excitation signal to excite an N/2 cascade connected stage receive filter. Each stage of the receive filter operates on a time shared basis on an adjacent pair of the N spectral parameters. The receive adaptive filter operation is the inverse of the transmit adaptive filter so that after digital to analog conversion the original speech is substantially reproduced.

22 Claims, 35 Drawing Figures

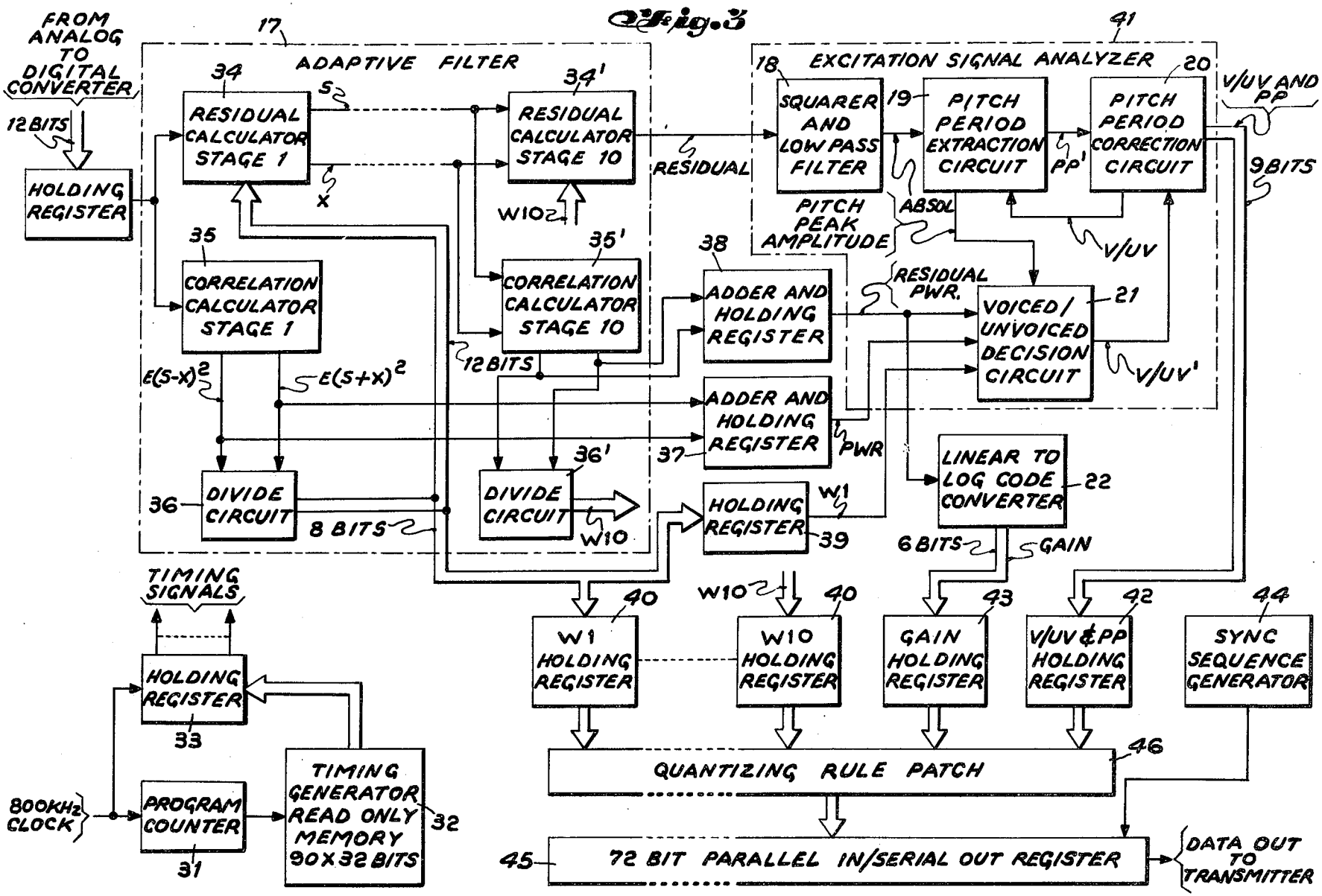
Fig. 3
FROM ANALOG TO DIGITAL CONVERTER
12 BITS
HOLDING REGISTER
ADAPTIVE FILTER
17
RESIDUAL CALCULATOR STAGE 1
34
CORRELATION CALCULATOR STAGE 1
35
DIVIDE CIRCUIT
36
RESIDUAL CALCULATOR STAGE 10
34'
CORRELATION CALCULATOR STAGE 10
35'
DIVIDE CIRCUIT
36'
12 BITS
8 BITS
W10
S
X
E(S-X)2
E(S+X)2
RESIDUAL
EXCITATION SIGNAL ANALYZER
41
SQUARER AND LOW PASS FILTER
18
PITCH PEAK AMPLITUDE
PITCH PERIOD EXTRACTION CIRCUIT
19
PITCH PERIOD CORRECTION CIRCUIT
20
V/UV AND PP
9 BITS
PP'
V/UV
V/UV'
ABSOL
RESIDUAL PWR.
VOICED/UNVOICED DECISION CIRCUIT
21
ADDER AND HOLDING REGISTER
38
ADDER AND HOLDING REGISTER
37
PWR
HOLDING REGISTER
39
W1
LINEAR TO LOG CODE CONVERTER
22
GAIN
6 BITS
TIMING SIGNALS
HOLDING REGISTER
33
PROGRAM COUNTER
31
800KHz CLOCK
TIMING GENERATOR READ ONLY MEMORY 90 X 32 BITS
32
W1 HOLDING REGISTER
40
W10 HOLDING REGISTER
40
W10
GAIN HOLDING REGISTER
43
V/UV & PP HOLDING REGISTER
42
SYNC SEQUENCE GENERATOR
44
QUANTIZING RULE PATCH
46
72 BIT PARALLEL IN/SERIAL OUT REGISTER
45
DATA OUT TO TRANSMITTER START
W1 ≥ .075
YES
NO
W1 ≥ 0.5
YES
4XNUMRAT ≥ 2.5X RES.
YES
NO
PWR ≥ 8 X RES.
YES
NO
W1 ≥ 0.0
YES
NUMRAT ≥ RES.
YES
W1 ≥ -0.1
NO
YES
PWR ≥ 15 X RES.
YES
V/UV = 1
V/UV = 0
END FROM TRANSMIT FILTER
PWR
FROM PITCH PERIOD EXTRACTION CIRCUIT
IPRP
INRP
FROM VOICED/ UNVOICED DECISION CIRCUIT
IPRV
PITCH PERIOD CORRECTION CIRCUIT
PP
V/UV
TO TRANSMISSION MULTIPLEXER
TO PITCH PERIOD EXTRACTION CIRCUIT
CONSTANTS

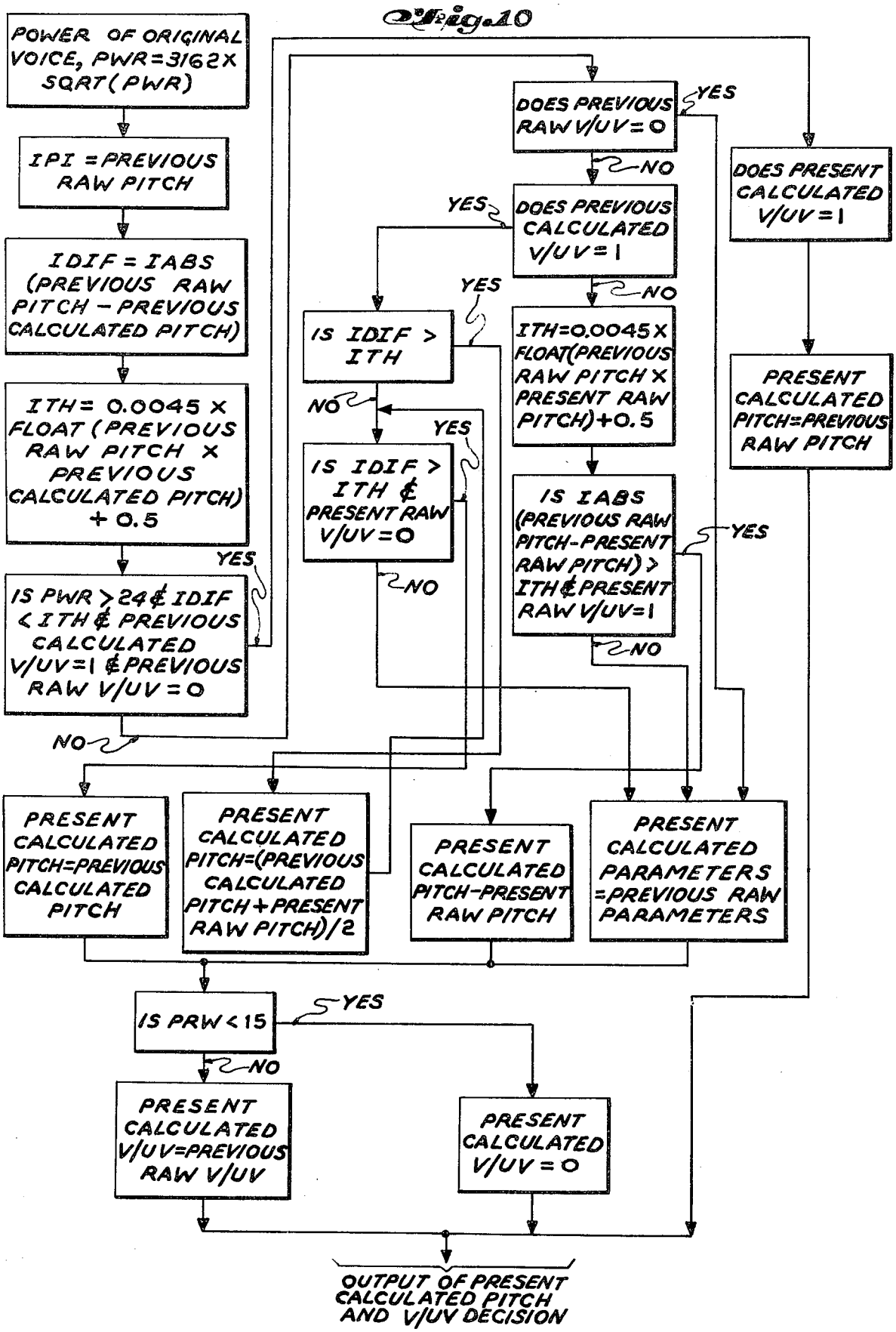
Fig.10
POWER OF ORIGINAL VOICE, PWR=3162X SQRT(PWR)
IPI =PREVIOUS RAW PITCH
IDIF = IABS (PREVIOUS RAW PITCH - PREVIOUS CALCULATED PITCH)
ITH= 0.0045 X FLOAT (PREVIOUS RAW PITCH X PREVIOUS CALCULATED PITCH) + 0.5
IS PWR > 24 & IDIF < ITH & PREVIOUS CALCULATED V/UV=1 & PREVIOUS RAW V/UV = 0
YES
NO
DOES PREVIOUS RAW V/UV = 0
YES
NO
DOES PREVIOUS CALCULATED V/UV = 1
YES
NO
DOES PRESENT CALCULATED V/UV = 1
IS IDIF > ITH
YES
NO
IS IDIF > ITH & PRESENT RAW V/UV = 0
YES
NO
ITH=0.0045 X FLOAT(PREVIOUS RAW PITCH X PRESENT RAW PITCH)+0.5
IS IABS (PREVIOUS RAW PITCH-PRESENT RAW PITCH) > ITH & PRESENT RAW V/UV=1
YES
NO
PRESENT CALCULATED PITCH=PREVIOUS RAW PITCH
PRESENT CALCULATED PITCH=PREVIOUS CALCULATED PITCH
PRESENT CALCULATED PITCH=(PREVIOUS CALCULATED PITCH + PRESENT RAW PITCH)/2
PRESENT CALCULATED PITCH-PRESENT RAW PITCH
PRESENT CALCULATED PARAMETERS =PREVIOUS RAW PARAMETERS
IS PRW < 15
YES
NO
PRESENT CALCULATED V/UV=PREVIOUS RAW V/UV
PRESENT CALCULATED V/UV = 0
OUTPUT OF PRESENT CALCULATED PITCH AND V/UV DECISION

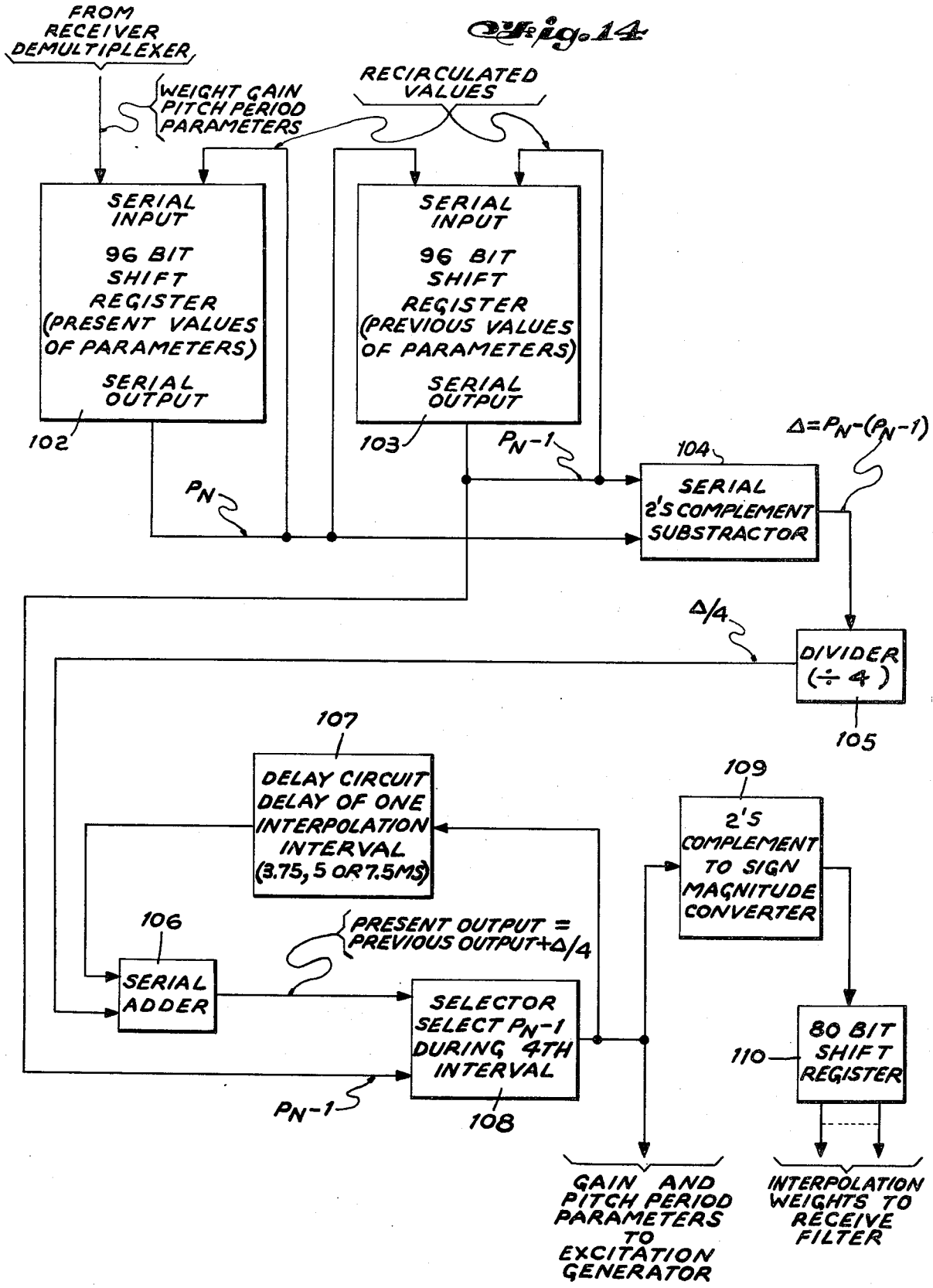
Fig. 14
FROM RECEIVER DEMULTIPLEXER
WEIGHT GAIN PITCH PERIOD PARAMETERS
RECIRCULATED VALUES
SERIAL INPUT 96 BIT SHIFT REGISTER (PRESENT VALUES OF PARAMETERS) SERIAL OUTPUT
102
SERIAL INPUT 96 BIT SHIFT REGISTER (PREVIOUS VALUES OF PARAMETERS) SERIAL OUTPUT
103
$P_N$
$P_N-1$
104
SERIAL 2'S COMPLEMENT SUBSTRACTOR
$\Delta=P_N-(P_N-1)$
$\Delta/4$
DIVIDER (÷4)
105
107
DELAY CIRCUIT DELAY OF ONE INTERPOLATION INTERVAL (3.75, 5 OR 7.5MS)
109
2'S COMPLEMENT TO SIGN MAGNITUDE CONVERTER
106
SERIAL ADDER
PRESENT OUTPUT = PREVIOUS OUTPUT+$\Delta/4$
SELECTOR SELECT $P_N-1$ DURING 4TH INTERVAL
108
$P_N-1$
110
80 BIT SHIFT REGISTER
GAIN AND PITCH PERIOD PARAMETERS TO EXCITATION GENERATOR
INTERPOLATION WEIGHTS TO RECEIVE FILTER DECISION CIRCUIT
B YES
A NO
T
J-K TYPE FLIP FLOP
J T K R Q
D-TYPE FLIP FLOP
D T R Q
FULL ADDER
Ci B A Co S
EXCLUSIVE-OR GATE
NOT GATE
AND GATE
OR GATE
INHIBIT GATE
MULTIPLEXER
SHIFT REGISTER
S R T INPUT FROM SQUARER
220
DIVIDER ÷ 16
32 BIT DELAY RESISTER
214
ADDER
215
32 BIT DELAY RESISTER
216
ADDER
217
32 BIT DELAY RESISTER
218
ADDER
219
DIVIDER ÷ 2
221
OUTPUT TO PITCH PERIOD ANALYZER

| | | |
|---|---|---|
| FIG. 23A | FIG. 23C | FIG. 23E |
| FIG. 23B | FIG. 23D | FIG. 23J |
| FIG. 23F | FIG. 23H | FIG. 23I |
| FIG. 23G | | |

CLK D
13 CLK
KPL
MSPER
KPL+MSPER
KP
KP+MSPER
KPL+2MSPER
KP+2MSPER
F3
F10
F19
F12
FA
LSP
LPER
251
265
13-BIT SR
DLSP

1-PHH
STUFF1
1-AP
2-AP
STUFF2
0.5 PHH
0.5 AP
0.75 AP
253
267
32 - BIT
SR 32
T
THR
DTHR
32CLK
FA
FI9
F3
A
B
Ci
Co
Q
D
R
CLK D
PH
AP
254
268
NUMRAT (TO V/UV DECISION CIRCUIT)
F3
FI9
MSPER
255
269
13 - BIT
SR 13
NSPER (OUTPUT PITCH PERIOD)
TABS(KP-LSP)
13CLK
IPRP
INRP
TO PITCH CORRECTION CIRCUIT
F12
F6

DIGITAL VOCODER

The invention herein described was made under a contract with the Department of the Navy.

BACKGROUND OF THE INVENTION

This invention relates to speech communication systems and more particularly to a vocoder type speech communication system.

SUMMARY OF THE INVENTION

An object of the present invention is to provide an improved vocoder.

Another object of the present invention is to provide a digital vocoder having a hardware implementation using a multi-processing design with repetitive serial arithmetic units.

A feature of the present invention is the provision of a digital vocoder comprising: a transmitter including a source of speech, an analog to digital converter coupled to the source to provide a first digital representation of the speech, an adaptive filter coupled to the analog to digital converter to derive from the first digital representation of said speech a digital prediction residual signal and digital spectral parameters, a pitch period extraction circuit coupled to the adaptive filter to produce a first digital excitation signal representing the pitch period of the speech, a voiced/unvoiced decision circuit coupled to the adaptive filter and the pitch period extraction circuit to produce a second digital excitation signal indicating when the speech is voiced and when the speech is unvoiced, an arrangement coupled to the adaptive filter to produce a digital number representing the gain of the adaptive filter, and a multiplexing and transmitting arrangement coupled to the adaptive filter, the pitch period extraction circuit and the voiced/unvoiced decision circuit to time multiplex and transmit the digital spectral parameters, said first and second digital excitation signals and the digital number; and a receiver including a receiving and demultiplexing arrangement coupled to the multiplexing and transmitting arrangement to receive and separate from each other the digital spectral parameters, the first and second digital excitation signals and the digital number, an excitation generator coupled to the receiving and demultiplexing arrangement responsive to the first and second digital excitation signals and the digital number to produce a third digital excitation signal, a receive filter coupled to the excitation generator and the receiving and demultiplexing arrangement responsive to the digital spectral parameters and the third excitation signal to provide a second digital representation of the speech which is substantially identical to the first digital representation of the speech, and a digital to analog converter coupled to the receive filter to provide a speech output substantially identical to the speech of the source.

Another feature of the present invention is the provision of a transmitter for a digital vocoder comprising: an analog to digital converter coupled to a source of speech to provide a digital representation of the speech; an adaptive filter coupled to the converter to derive from the digital representation of the speech to digital prediction residual and digital spectral parameters; a pitch period extraction circuit coupled to the filter to produce a first digital signal representing the pitch period of the speech; a voiced/unvoiced decision circuit coupled to the filter and the extraction circuit to produce a second digital excitation signal indicating when the speech is voiced and when the speech is unvoiced; an arrangement coupled to the filter to produce a digital number representing the gain of the adaptive filter, and a multiplexing and transmitting arrangement coupled to the filter, the extraction circuit and the decision circuit to time multiplex and transmit the digital spectral parameters, the first and second digital excitation signals and the digital number.

Still another feature of the present invention is the provision of a receiver for a digital vocoder comprising: a receiving and demultiplexing arrangement to receive a serial digital pulse train containing digital spectral parameters derived in an adaptive filter at a transmitter from input speech, first and second digital excitation signals derived at the transmitter from the adaptive filter and a log coded digital number representing gain in the adaptive filter and to separate the contents of the pulse train; an excitation generator coupled to the arrangement responsive to the first and second excitation signals and the digital number to produce a third excitation signal; a receive filter coupled to the generator and the arrangement responsive to the digital spectral parameters and the third excitation signal to provide a digital representation of speech; and a digital to analog converter coupled to the filter to provide a speech output which is substantially identical to the input speech.

BRIEF DESCRIPTION OF THE DRAWING

Above-mentioned and other features and objects of this invention will become more apparent by reference to the following description taken in conjunction with the accompanying drawing, in which:

FIG. 3 is a still more specific block diagram of the transmitter of the digital vocoder of FIG. 2;

FIG. 10 illustrates the pitch period correction circuit algorithm flow chart defining the various decisions to be made by the block diagram of FIG. 9;

FIG. 14 is a block diagram of the parameter interpolator of FIG. 11;

DESCRIPTION OF THE PREFERRED EMBODIMENT

Figures 1, 17:
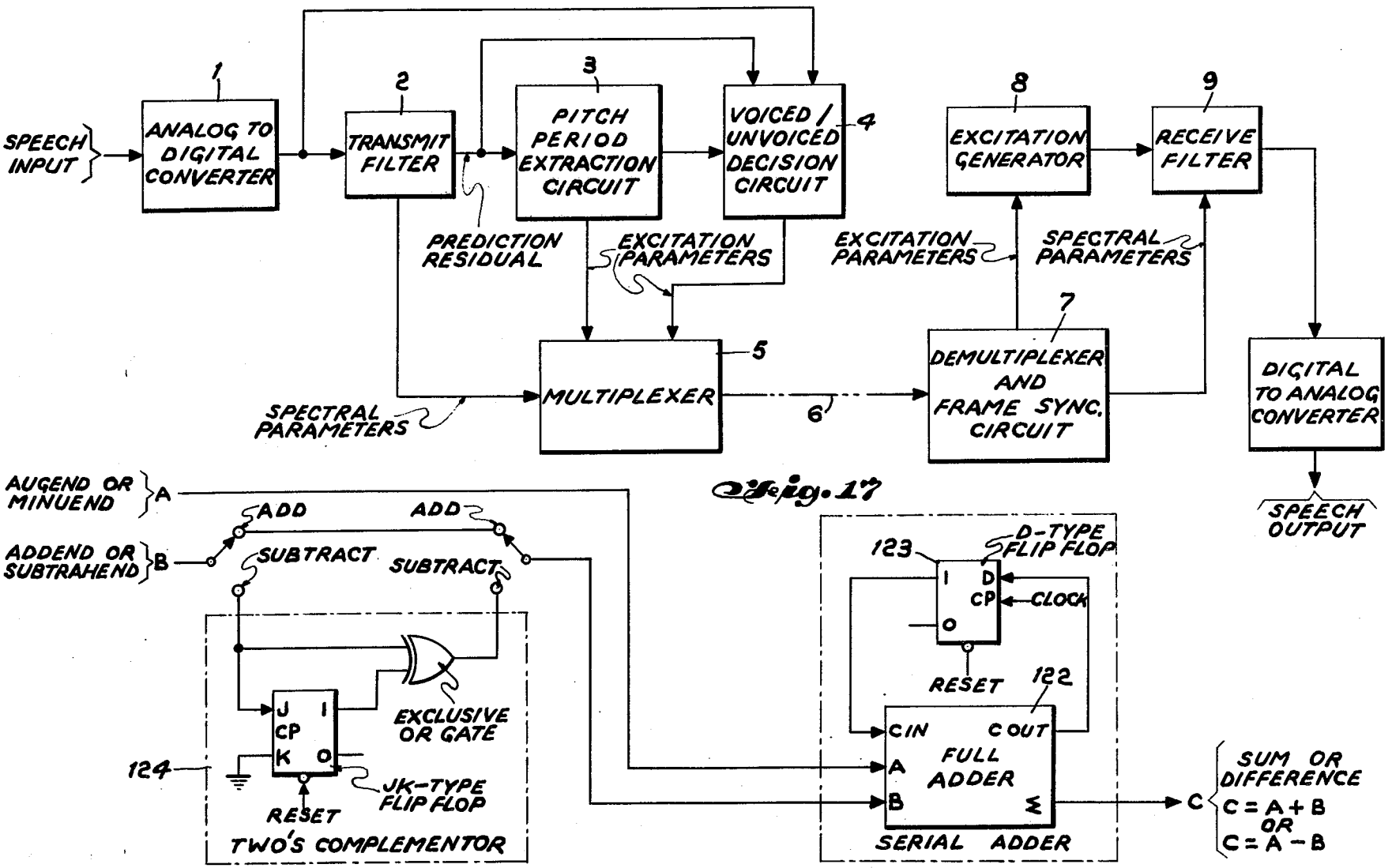
FIG. 1 is a general block diagram of a digital vocoder in accordance with the principles of the present invention.
FIG. 17 is a block diagram of an adder and a subtractor circuit employed as one of the building blocks of the foregoing figures of the drawing.

FIG. 1 illustrates the basic block diagram of the digital vocoder in accordance with the principles of the present invention. Speech input to the transmitter is sampled and converted to a digital representation in the analog to digital converter 1. Spectral parameters are derived from transmit filter 2 and excitation parameters are derived from pitch period extraction circuit 3 and the voiced/unvoiced decision circuit 4. The spectral parameters and excitation parameters are multiplexed in multiplexer 5 and transmitted to the receiver over transmission path 6. The transmit multiplexed signal is demultiplexed and the receiver is frame synchronized in demultiplexer and frame sync circuit 7. The excitation parameters and spectral parameters are coupled to excitation generator 8 and receive filter 9, respectively, to synthesize digital speech. The digital speech is then coupled to digital to analog converter 10 to recover the analog speech for utilization. All processing from converter 1 in the transmitter to converter 10 in the receiver is digital and implemented with logic circuits.

Transmit filter 2 contains an adaptive filter or predictor which forms an estimate of a present input speech sample from stored values of previous input speech samples. This estimate is subtracted from the present input sample giving a prediction error or prediction residual which is one of the transmit filter outputs. The receive filter 9, an adaptive filter or predictor, has a transfer function which is inverse to that of the transmit filter 2.

The prediction of the present speech sample in transmit filter 2 is a weighted sum of previous input samples. The weighing coefficients are the spectral parameters of filter 2. A least squares adaption algorithm is used to continuously adapt these parameters to the changing characteristics of the input speech sounds.

The adaption algorithm calculates the weighting coefficients from continuously updated correlation coefficients of successive speech samples.

The weighting coefficients in transmit filter 2 are called spectral parameters because they contain the same short term spectral information obtained by a filter bank in a conventional vocoder. The advantage of using the adaptive predictor or filter instead of a filter bank or its equivalent is that the predictor parameters (the spectral parameters) provide an accurate representation of the various resonances, or formants, in the speech spectrum with far fewer parameters than required with a filter bank. Typically, only 8 or 10 spectral parameters are required to give a complete spectral representation of the speech over a standard 4,000 hertz channel bandwidth.

The pitch period extraction circuit 3 responds to the prediction residual at the output of filter 2, rather than the speech input to provide the pitch period as one of the excitation parameters.

Figure 2:
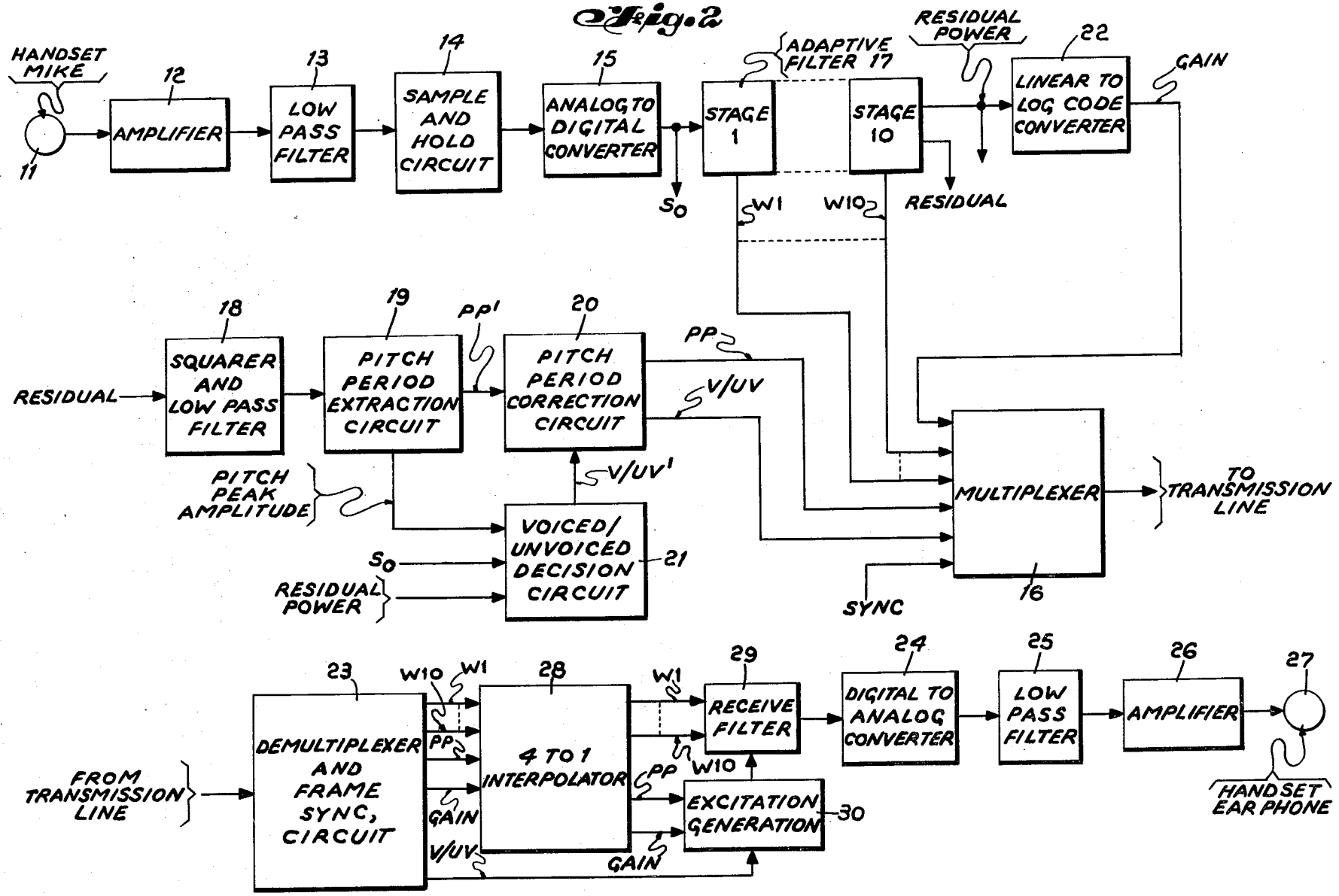
FIG. 2 is a more specific block diagram of the digital vocoder of FIG. 1.

Referring to FIG. 2, there is illustrated a more detailed block diagram of the digital vocoder in accordance with the principles of the present invention. A selected multiprocessing system design has been incorporated in implementing the block diagram of FIG. 2 and each of the blocks or sub-systems shown therein exist as physical entities since there is no common time-shared equipment.

The transmitter input circuit includes a handset mike 11 coupled to a vogad amplifier 12 whose output is coupled to a low pass filter 13. The output of filter 13 is coupled to a sample and hold circuit 14. The output of circuit 14 is coupled to a 12 bit analog-to-digital converter 15, which converts the speech to the digital format required for further operation thereon. The output circuit of the transmitter contained in block 16 labeled "MULTIPLEXER" includes holding registers for the speech parameters, and multiplexing and synchronizing circuits to serially transmit the speech data.

Four major functions are implemented within the digital vocoder transmitter. These are the adaptive filter 17 (transmit filter 2 of FIG. 1), pitch extraction including squarer and low pass filter 18 and pitch period extraction circuit 19. To the output of circuit 19 is coupled pitch period correction circuit 20 and a voiced/unvoiced decision circuit 21. It should be noted that squarer and low pass filter 18 are coupled to the residual output of the 10th stage of filter 17 and that the inputs to circuit 21 are pitch peak amplitude from circuit 19, the output $S_o$ of converter 15 and the residua. power output from the 10th stage of filter 17.

The digital speech from converter 15 is applied to the input of the adaptive filter. Filter 17 includes ten identical cascaded stages, each of which calculate their filter stage weight. as described hereinbelow with respect to FIGS. 3, 4, 5 and 6. Adaptive filter 17 is a 10 stage Itakura type cascade derived from Equation (1) of an article by F. Itakura and S. Saito, "Digital Filtering Techniques for Speech Analysis and Synthesis", pages 261–264, Paper C25C1, Seventh International Congress or Acoustics, Budapest, 1971.

The prediction residual from the last stage of filter 17 is squared and filtered in squarer and low pass filter 18 before being applied to the input of circuit 19. The derived pitch period data is then applied to the pitch correction circuit 20. The amplitude of the pitch peaks of the squared and low pass filtered residual, together with the rms (root means square) value of the input speech and residual power form the input to the voiced/unvoiced decision circuit 21. The voicing decision is applied to pitch correction circuit 20 for possible correction therein before being transmitted.

The residual power output from the 10th stage of filter 17 is applied to linear to log code converter 22 to provide a digital number representative of the gain of the filter which is also coupled to multiplexer 16 to be transmitted to the receiver in the multiplexed format.

The input circuit to the receiver includes demultiplexer and frame sync circuit 23. The receiver output circuit includes a 12 bit digital-to-analog converter 24, a low pass filter 25, a buffer amplifier 26 and the headset earphone 27. A linear interpolator 28 performs an interpolation on the received speech parameter data to obtain excitation and filter parameter updates at a rate four times the transmit update or frame rate. The operations performed in the receive filter 29 (receive filter 9 of FIG. 1) are basically the inverse of that performed in the adaptive filter of transmit filter 17. Excitation generator 30 supplies one input signal to receive filter 29. The excitation is either a series of pulses determined by the pitch period parameter for a voiced condition or by random noise pulses for an unvoiced condition. The weighted coefficients W1-W10 are other inputs to filter 29.

Referring to FIG. 3, there is illustrated therein a still more specific block diagram of the transmitter of the digital vocoder of the present application. Timing and control signals for all circuits of the transmitter are derived from a pre-programmed read-only memory module accessed at an 800 khz (kilohertz) rate. The program is controlled by program counter 31 which controls the read-only memory 32. The output data word from memory 32 is stored in holding register 33 clocked by the 800 khz signal thereby ensuring synchronization of all control and timing signals.

TABLE I

PARAMETER CODING AND MULTIPLEXING
Total and Spectral Parameters Only, Number of Bits Per Frame

| UPDATE INTERVAL | TRANSMISSION RATE 4800 B/S | 3600 B/S | 2400 B/S |
|---|---|---|---|
| 10 MS | 48 | 36 | |
| 15 | 72(57) | 54 | |
| 20 | 96(81) | 72(57) | 48(33) |
| 25 | | 90 | 60(45) |
| 30 | | | 72(57) |

| EXCITATION PARAMETERS | |
|---|---|
| Pitch Period | 7 |
| Residual Level | 6 |
| Voicing Parameter | 1 |
| Framing | 1 |
| TOTAL | 15 |

Table I lists the code formats for three data rates; namely, 4800, 3600 and 2400 bits per second.

higher order of parameters W7, W8, etc. In particular, rules A6 and B3 were found to be the best for 33 and 57 bit coding. It was further found that using fewer bits for quantizing caused greater degradation in speech quality than using a longer update interval. Therefore the 72-bit frame was selected, which corresponds to 15, 20, and 30 millisecond update intervals for the data rates of 4800, 3600, and 2400 bits per second, respectively. The reflection coefficients whose magnitude does not exceed one are coded with 57 bits, using rule B3 where there are 8, 7, 6, 6, 5, 5, 5, 5, 5, 5 bits for the first through tenth coefficient. The excitation parameters are coded with 7 bits for pitch period, 6 bits for mean square prediction residual with approximately logarithmic coding, and 1 bit each for voicing and frame sync information.

A full operation cycle of the transmitter corresponding to a 125 microsecond sample period, consists of 90 individual operations or instructions of 1.38 microsecond duration each. The adaptive filter 17, squarer and low pass filter 18 and pitch period extraction circuit 19 repeat these operations each sample period, while the voice decision carried out in circuit 21 and the pitch period correction circuit 20 are activated once every 40 samples and require a full sample period to complete their functions.

Functionally, the output of converter 15 (FIG. 2) consists of a 12 bit word in 2's complement format and forms the input to the first stage of the cascade transmit filter or adaptive filter 17. Within filter 17 residuals and correction coefficients are calculated in calculators 34 and 35, respectively, for each stage of filter 17 with the calculation taking place every sample period and each filter weight is calculated by a divide circuit 36 from the output of correlation calculator 35 and updated in the corresponding residual calculator 34 each sample period. Each filter weight therefore gets updated every sample period. The residual from the tenth stage, namely, from calculator 34', which is a 16 bit serial 2's complement word, forms the input to squarer and low pass filter 18. Both the input signal power and residual power are calculated from the outputs of the first and last correlation calculator stages, and stored in adding and holding registers 37 and 38, respectively. These parameters are updated once every 40 samples during the same cycle weight W1 is calculated and stored in holding register 39. In addition, the eight most significant bits of the calculated weight W1 through W10 are

TABLE II

| RULE NO. | NO. OF STAGES | QUANTIZING RULES BITS PER COEFFICIENT W1 | W2 | W3 | W4 | W5 | W6 | W7 | W8 | W9 | W10 | W11 | W12 |
|---|---|---|---|---|---|---|---|---|---|---|---|---|---|
| (For Total Number of Bits = 33) | | | | | | | | | | | | | |
| A1 | 8 | 7 | 6 | 4 | 3 | 3 | 3 | 3 | 3 | 0 | 0 | 0 | 0 |
| A2 | 10 | 6 | 5 | 3 | 3 | 3 | 3 | 3 | 3 | 2 | 2 | 0 | 0 |
| A3 | 10 | 5 | 4 | 3 | 3 | 3 | 3 | 3 | 3 | 3 | 3 | 0 | 0 |
| A4 | 8 | 8 | 7 | 3 | 3 | 3 | 3 | 3 | 3 | 0 | 0 | 0 | 0 |
| A5 | 8 | 5 | 4 | 4 | 4 | 4 | 4 | 4 | 4 | 0 | 0 | 0 | 0 |
| A6 | 8 | 6 | 5 | 4 | 4 | 4 | 4 | 3 | 3 | 0 | 0 | 0 | 0 |
| (For Total Number of Bits = 57) | | | | | | | | | | | | | |
| B1 | 12 | 5 | 5 | 5 | 5 | 5 | 5 | 5 | 5 | 5 | 5 | 4 | 3 |
| B2 | 10 | 6 | 6 | 6 | 6 | 6 | 6 | 6 | 5 | 5 | 5 | 0 | 0 |
| B3 | 10 | 8 | 7 | 6 | 6 | 5 | 5 | 5 | 5 | 5 | 5 | 0 | 0 |
| B4 | 8 | 8 | 8 | 8 | 7 | 7 | 7 | 6 | 6 | | | | |

Table II shows the rules for different parameter coding conditions. Best results are obtained by making the number of bits for the lower order parameters, W1, W2 etc., as high as possible even at the expense of the stored in holding registers 40. The output of excitation signal analyzer 41 includes a one bit voiced/unvoiced decision and an eight bit unsigned pitch period which updates the multiplexer holding register 42 once every 40 samples. In addition, the logarithm to the base two of the square root of the residual power is calculated in linear to log code converter 22 and stored in holding register 43. The output of converter 22 is a 6 bit unsigned integer. A sync sequence generator 44 provides the synchronization information for the receiver and is coupled to the multiplexer which is in the form of a 72 bit parallel in/serial out register 45. The digital words from registers 40, 42 and 43 are coupled to a quantizing rule patch 46 which adjusts the number of bits for the weighting coefficients W1 and W10 according to the quantizing rules in Table II. According to the present example, rule B3 is employed which provides the number of bits for each of the coefficients as illustrated in Table II.

Figure 4:
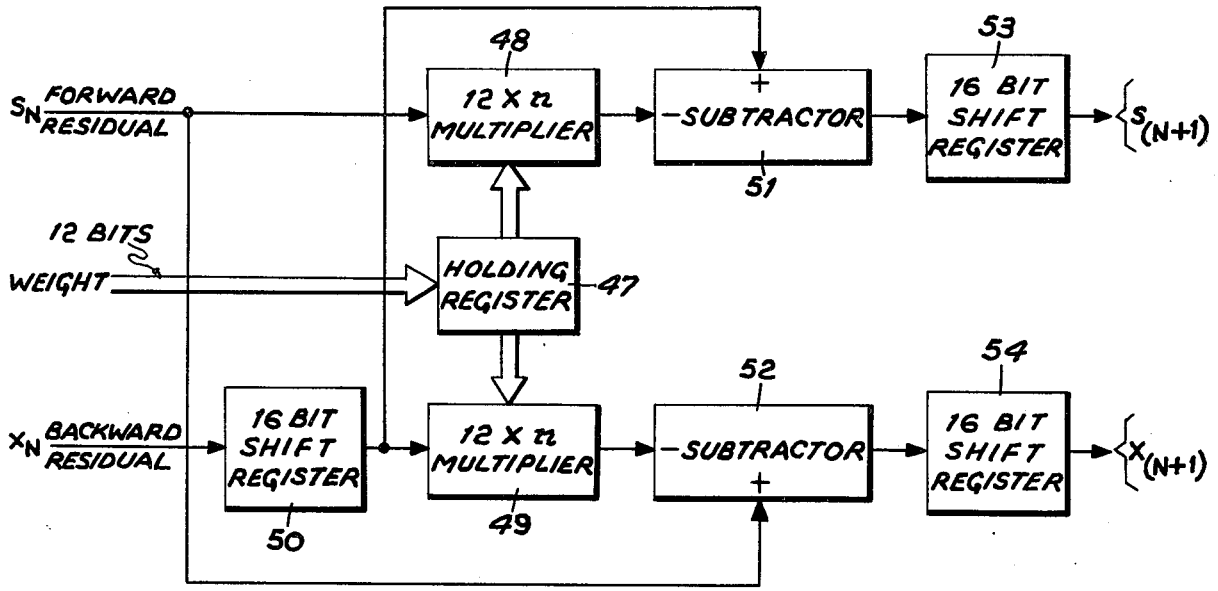
FIG. 4 is a block diagram of the residual calculator of FIG. 3.

Referring to FIG. 4, there is disclosed therein the block diagram of one of the residual calculators 34 implementing filter 17. Filter 17 includes ten residual calculators and ten correlation calculators and ten dividers (divider circuit 36). The residual calculator and correlation calculator of each stage operate individually on the same input data. The output of the correlation calculator forms the input to divider circuit, which calculates the filter weighting coefficient. The updated value of the weighting coefficients is loaded into holding register 47 at the beginning of every sample cycle. The remainder of the cycle consists of the serial multiplication of the weight with the forward residual in multiplexer 48 and the backward residual in multiplexer 49 after passing through a sixteen bit shift register 50 and subtracting the resulting products from the backward and forward residual in subtractors 51 and 52, respectively. The residuals are 16 bit numbers represented in 2's complement format and the weighting coefficients are 12 bit numbers in signed magnitude format. Multipliers 48 and 49 are therefore 12 × 16 multipliers. The resulting answer is truncated to 16 bits and delayed by one sample period before application to the following stage through shift registers 53 and 54.

Figure 5:
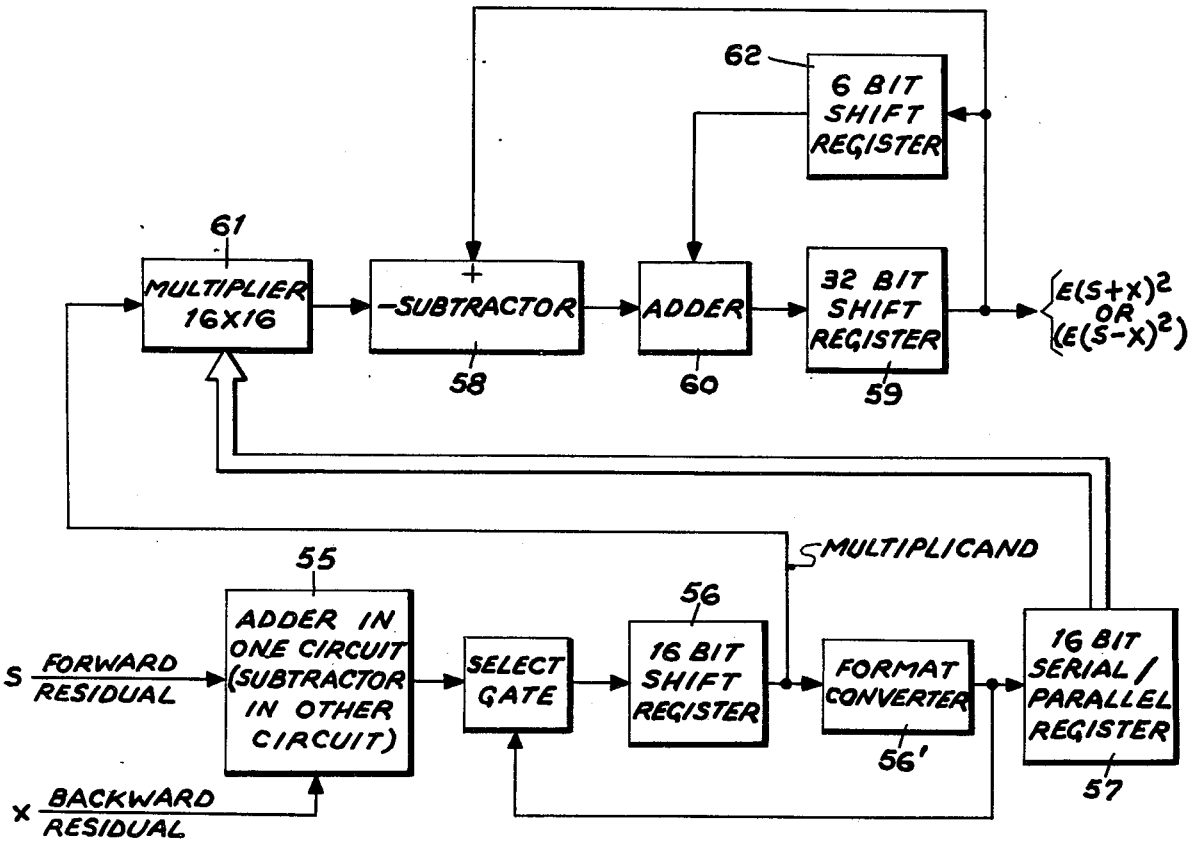
FIG. 5 is a block diagram of the correlation calculator of FIG. 3.

Referring to FIG. 5, there is illustrated therein a functional block diagram of a correlation calculator. This circuit is repeated twice in each stage with the adder 55 at the input of the circuit being replaced by a subtractor in one of the two circuits, resulting in the calculation of both the average value of the sum and difference of the forward and backward residuals.

Three separate operations are performed in the correlation calculator circuit. First, one half of the sum or difference of the residual is calculated serially and stored in a 16 bit shift register 56. The factor of one half is required to ensure no register overflows will occur. The absolute value of the result sum or difference is then formed serially in format converter 56' and loaded into the multiplicand shift register 56 and multiplier holding register 57. At this point the updated calculation of the correlation coefficients begins. The square of the sum or difference is calculated serially and subtracted from the previous value of the correlation coefficients in subtractor 58. The previous values of the correlation coefficients are stored in shift register 59. The resultant differences are then divided by 64 and added to the previous values of the correlation coefficients by adder 60. Division by 64 is accomplished by delaying the previous correlation coefficient by 6 bits relative to the differences. The newly calculated coefficients are stored in a 32-bit shift register 59. The circuit requires a 16 × 16 multiplier module 61 and results in a 32 bit correlation coefficient.

Figure 6:
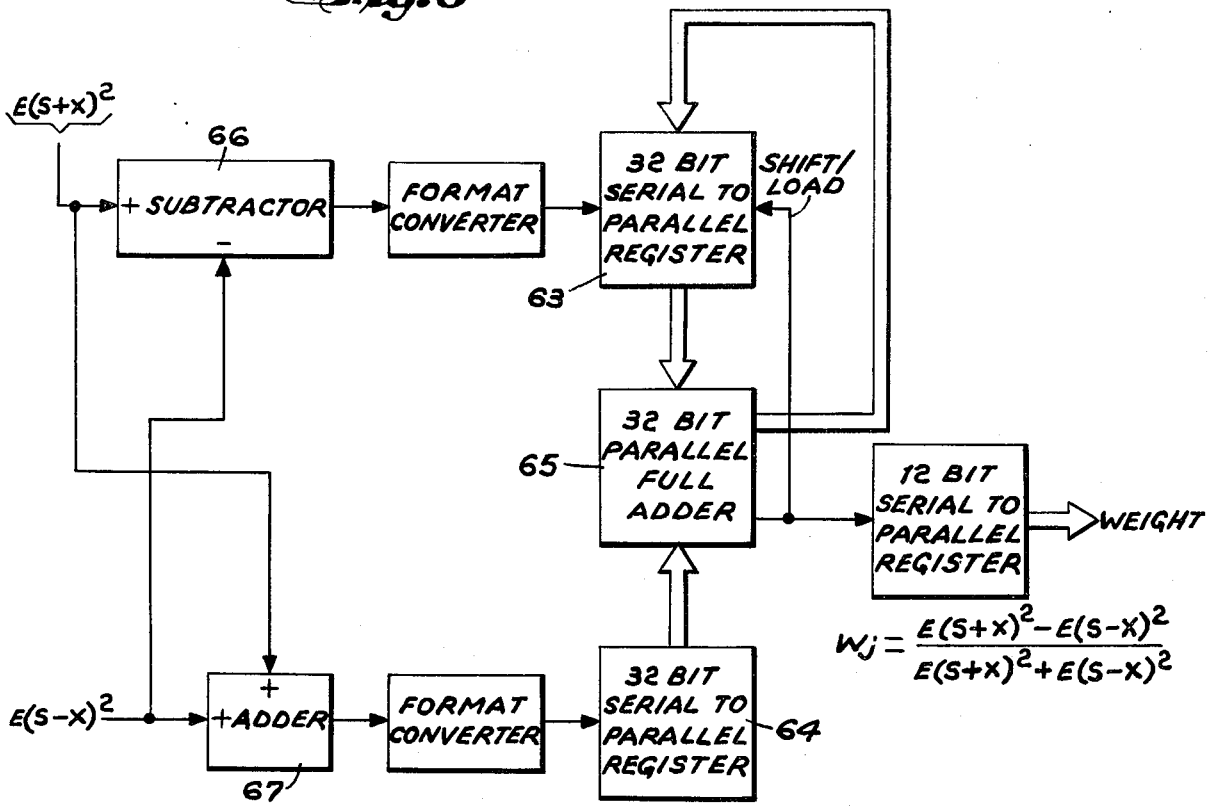
FIG. 6 is a block diagram of the divide circuit of FIG. 3.

Referring to FIG. 6, there is illustrated therein the block diagram of a divide circuit. The filter weighting coefficient is calculated as one half the difference divided by one half the sum of the calculated correlation coefficients. The weighting coefficient is calculated as a 12 bit signed magnitude integer having a range of ±1. Illegal divide operations; that is, divisions whose resulting quotient would exceed the weighting range, are detected and a value of zero is returned for the weight coefficient.

The divide circuit operates as follows. At the beginning of each sample period, the serial outputs of the correlation calculator stage are applied to the divider circuit. The absolute value of the sum and difference of the correlation coefficients as provided by subtractor 66 and adder 67 are found and loaded into the divisor and dividend holding registers 63 and 64. In addition, the sign of the resulting quotient is determined. The division is accomplished by a series of successive subtractions and shifts. Functionally, the divisor is first subtracted from the dividend. A positive difference is detected as an illegal divide and the quotient is set to zero. A negative difference results in the multiplication of the dividend by 2. The operation is then repeated to determine the most significant bit of the quotient. A positive difference causes the quotient bit to be set to "1" and the difference to be loaded into the dividend register 63. A negative difference causes the quotient bit to be set to "0" and the dividend to be multiplied by 2. The operation is then repeated for the lower order bits of the quotient in adder 65. The division requires one sample period.

The squarer and low pass filter 18 and pitch period extraction circuit 19 are fully described hereinbelow with respect to FIGS. 19, 20 and 23.

Figure 7:
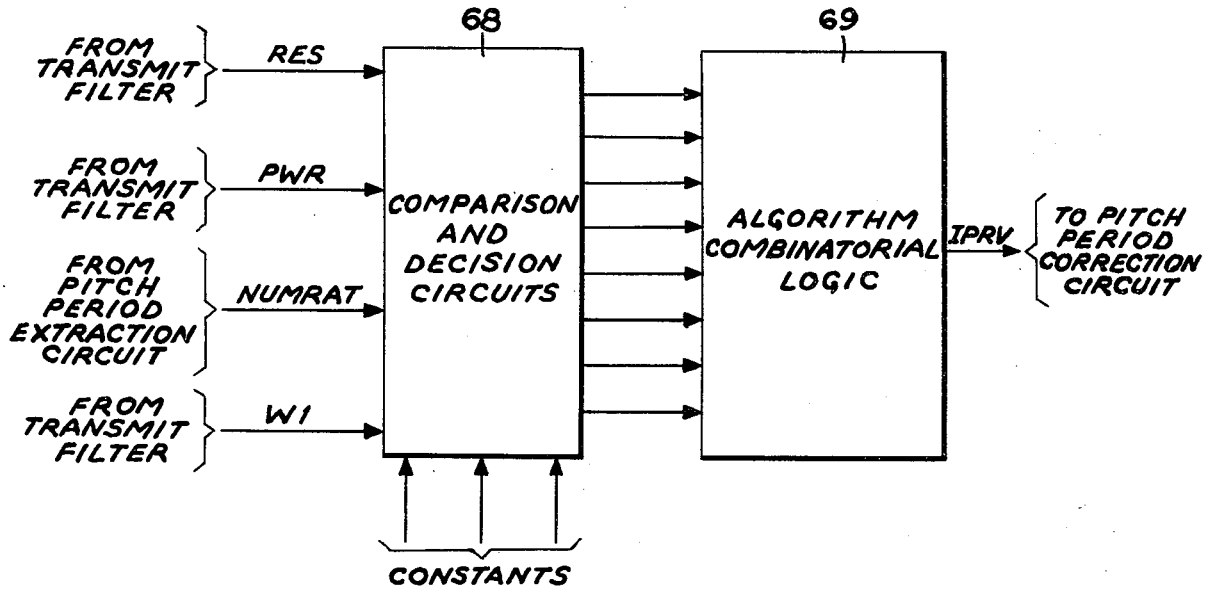
FIG. 7 illustrates the algorithm block diagram of the voiced/unvoiced decision circuit of FIG. 3.

Referring to FIG. 7, there is disclosed therein a block diagram for the algorithm for the voiced/unvoiced decision circuit which includes comparison and decision circuits 68 and algorithm combinatorial logic 69. The inputs to comparison and decision circuits 68 includes four lines of serial data, one of which, namely, W1 has 12 bits, the other three inputs having 32 bits each. Referring to the block diagram, these three inputs are RES, PWR, and NUMRAT. The one bit serial output, the V/UV decision (IPRV) is then available 36 clock pulses after the data appears at the inputs. The V/UV function is accessed (subject to an update) every 40 samples.

Figure 8:
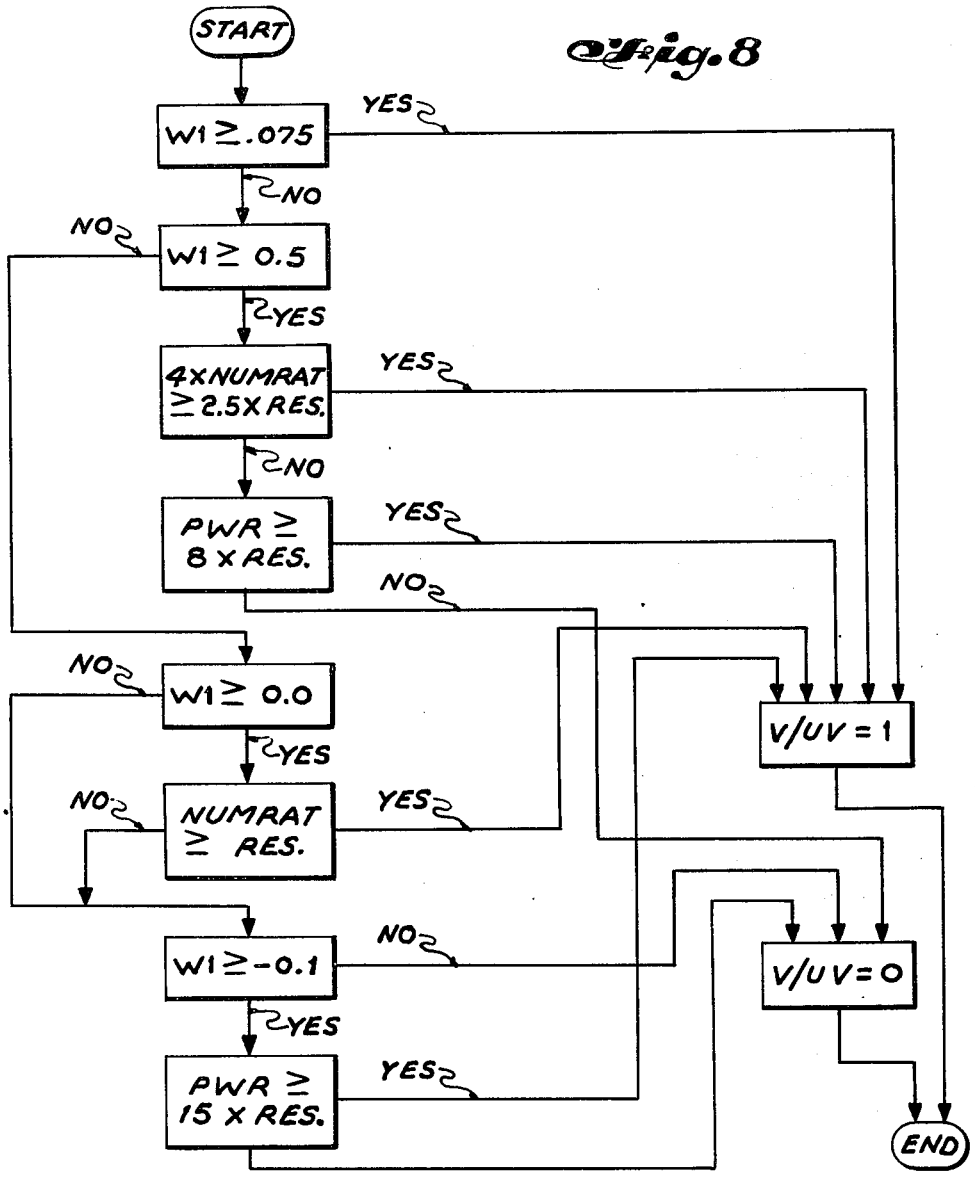
FIG. 8 illustrates the voiced/unvoiced decision algorithm flow chart defining the various decisions to be made by the block diagram of FIG. 7.

The voiced/unvoiced algorithm is shown in FIG. 8 and requires eight decisions which are made by employing a serial comparator. The comparator subtracts one input from the other and clocks the sign of the difference into a flip-flop to be used as the decision. Inputs to the algorithm are generated in other portions of the vocoder as indicated by the labels of the input of FIG. 7. These inputs are used in the comparisons along with certain constants representing threshold levels. Once all decisions have been determined, they are fed to a logical equivalent of the flow chart which is the logic square of FIG. 7 which then produces the answer: either a 1 or 0 for voiced or unvoiced, respectively, at the output.

Figure 9:
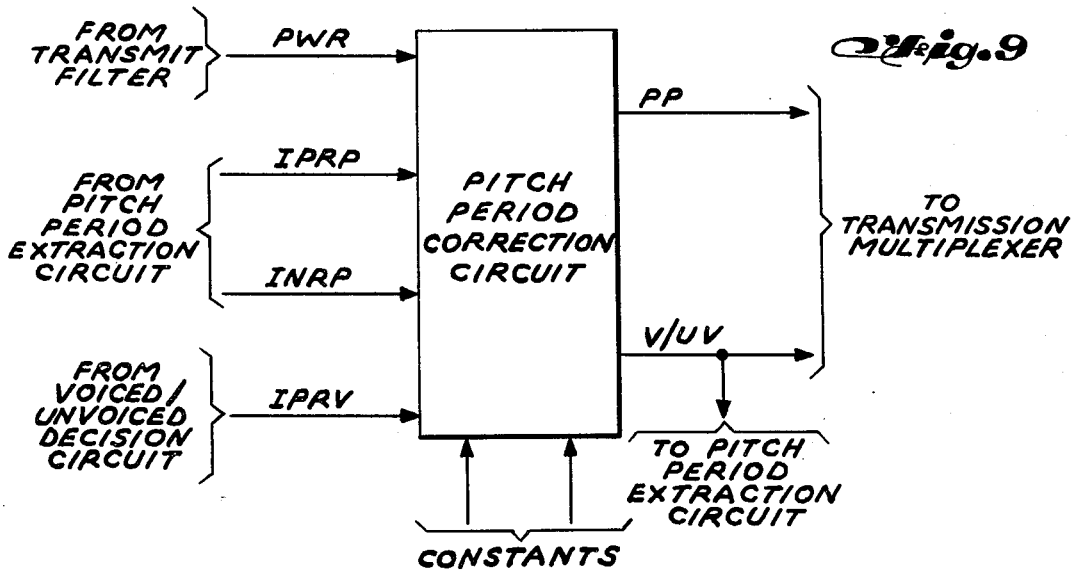
FIG 9 is an algorithm block diagram of the pitch period correction circuit of FIG. 3.

Referring to FIGS. 9 and 10, there is illustrated therein the inputs and outputs to the pitch period correction circuit 70 and the flow chart of the pitch period correction algorithm. Pitch period correction circuit 70 functions basically in the same manner as the pitch period extraction circuit fully disclosed in FIGS. 20 and 23 and the description thereof. There, however, is one difference which changes, slightly, the character but not the basic operation of the hardware.

The difference is stated as follows. There exists, in the pitch period correction algorithm, a need to multiply two variables and also multiply this product by a constant. The serial multiplier requires that it be loaded before serial multiplication can take place. Provision must be made for additional time in the cycle in which to clock the multiplicand through the multiplier circuit. The time required to multiply this result by the constant 0.0045 must also be provided.

There are four serial inputs to the pitch correction function. The inputs INRP and IPRP are the raw pitch periods from the previous sample and the sample before that. These signals are both 13 bit words, and are received from the pitch period extraction circuit. The signal PWR is the power of the original voice, a 32-bit serial word, and is taken from the first stage of the transmit filter correlation calculator. The last input, IRPV, is the one bit raw voicing decision.

The pitch period correction circuit itself, as mentioned above, functions in a manner similar to the pitch period extraction circuit and, therefore, is shown as a single functional box. There are only two outputs from this circuit, namely, PP and V/UV. The signal PP represents the pitch period from two samples prior to the present sample (the total excitation signal generator has a two sample delay and is a serial 13-bit word). The other output, V/UV, is a single bit voicing decision which is the output from the V/UV decision circuit which has been processed by the correction circuit. Both outputs are updated every sample and comprise the final realization of the excitation signal analyzer 41 of FIG. 3. These signals are sent to the multiplexer circuit for transmission where they are sampled every 5 miliseconds.

The pitch period correction algorithm of FIG. 10 improves the quality of the synthesized speech by eliminating any large changes in the pitch period from one update interval to the next. The algorithm operates by using raw pitch and voiced/unvoiced data, obtained from the pitch period extractor and voiced/unvoiced decison circuit and modifying it in accordance with prescribed criteria.

The final pitch period and voicing decision outputs of the algorithm are referred to as the calculated data. The inputs are the raw data. The algorithm uses the present raw data and the previous, one sample back, raw and calculated data to determine the values of the present calculated data. The power of the original speech and two calculated parameters, IDIF and ITH, are also used as criteria to determine the smoothed output. After a decision is made on the value of calculated pitch, a final decision is made on voicing depending on the value of the power of the original speech. If the power is below a predetermined level, the speech is assumed unvoiced.

Figure 11:
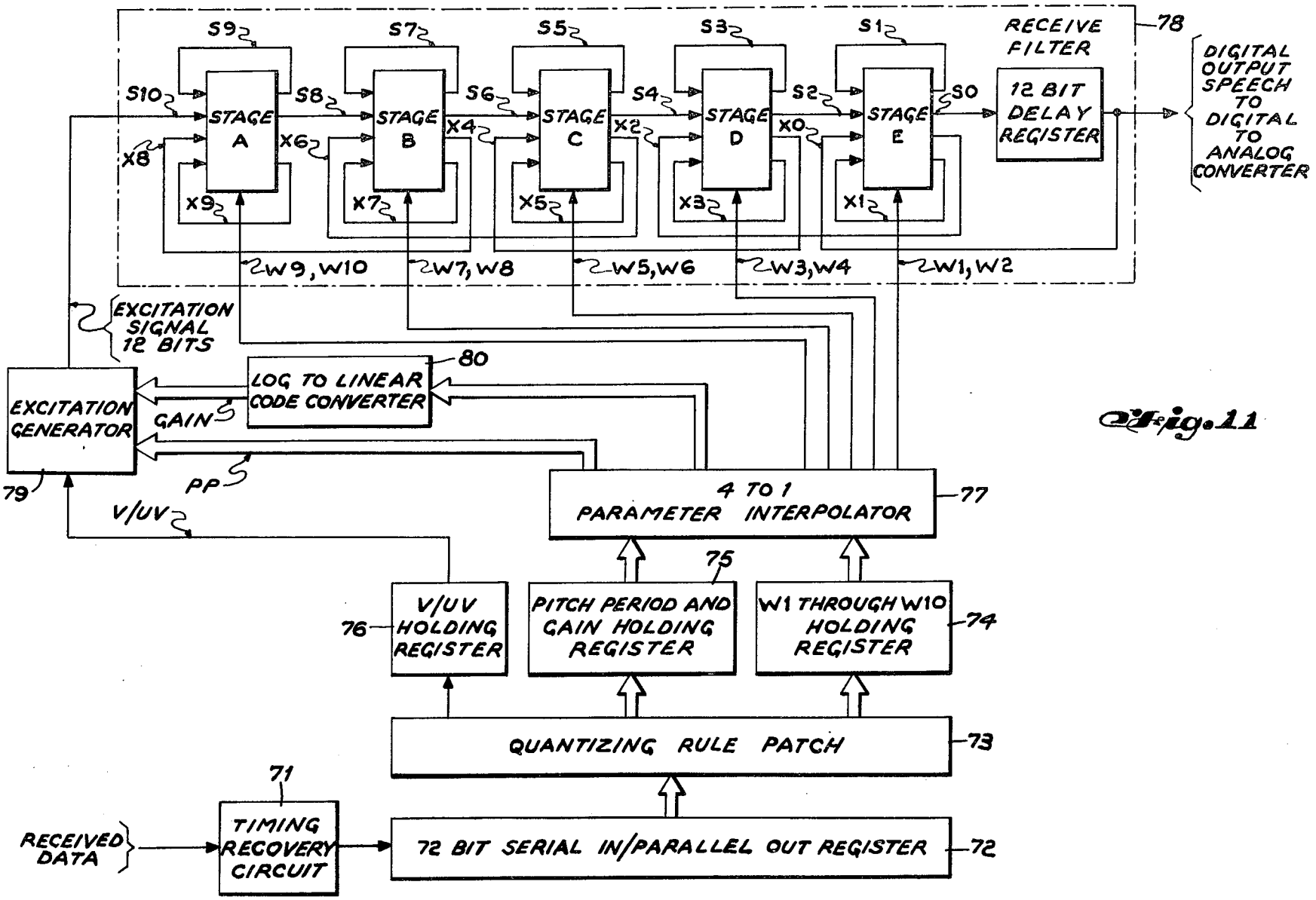
FIG. 11 is a still more specific block diagram of the receiver of the digital vocoder of FIG. 2.

Referring to FIG. 11, there is disclosed therein a block diagram in greater detail of the receiver of the digital vocoder of this invention. As in the transmitter, timing and control signals are derived from a preprogrammed read-only memory module synchronized by the timing recovery circuit 71. The receive read-only memory in circuit 71 is accessed at a 576 khz rate and a full operation cycle, corresponding to the 125 microsecond sample period, consists of 72 individual operations of 1.73 microseconds duration each. The received data is coupled to a demultiplexer which is illustrated to be a 72-bit serial in/parallel output register 72, whose parameter outputs are coupled to quantizing role patch 73 which operates in an inverse relationship to the quantizing rule patch 46 of the transmitter to return all of the weighting coefficients to the same number of digits in accordance with the employed rule disclosed in Table II. The output of patch 73 is coupled to holding register 74 which holds the weighting coefficients W1–W10, holding register 75 which holds the pitch period and gain digit word and holding register 76 which holds the V/UV indicating bit. The parameter interpolator 77 updates the filter parameters W1–W10 and the excitation signal parameters, pitch period and gain, every 30, 40 or 60 sample periods for the corresponding data transmission rates of 4800, 3600, and 2400 bits per second, respectively. The filter weighting coefficients are transmitted to the receive filter 78 serially in signed magnitude format. The excitation serial generator 70 and receive filter 78 provide outputs consisting of 12 bits each sample period.

The modified receiver filter algorithm, using the half sample delay method, permits the calculation of all even numbered filter taps during the first half of the sampling period and odd numbered filter taps during the second half of the interval. The receive filter is implemented using five identical filter stage modules A–E, which are time shared. The gain word is converted from a log code representation to a linear code representation by converter 80.

Figure 12:
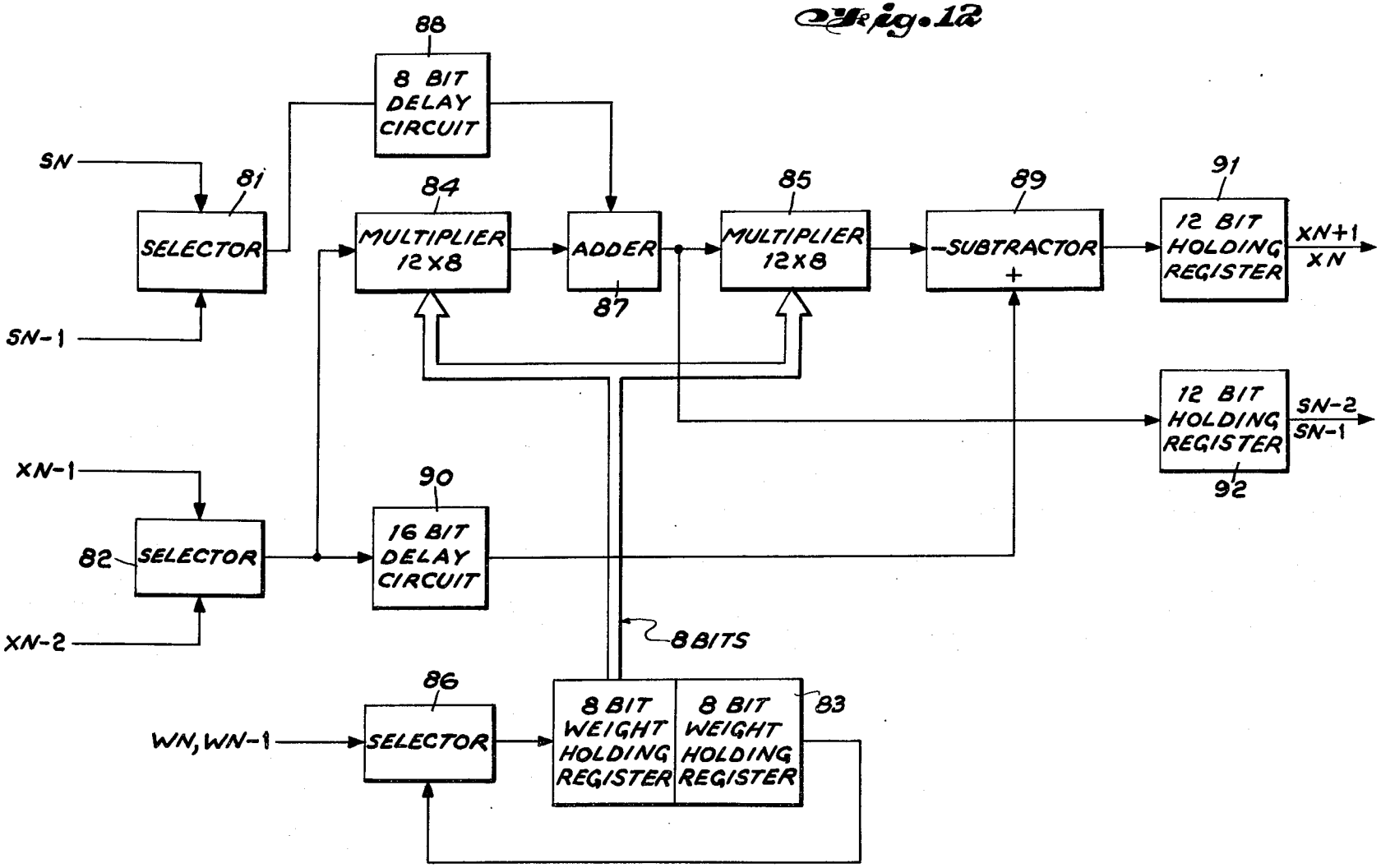
FIG. 12 is a block diagram of a receive filter stage of FIG. 11.

Referring to FIG. 12, there is disclosed therein one of the stages A–E of the receive filter 78 of FIG. 11. The previously calculated residuals delayed by one half the sample period are multiplexed at the input of the filter stage module by properly controlled selectors 81 and 82. Table III lists the inputs and calculated residuals for each stage during the first and second half of the sampling interval.

TABLE III

| STAGE | INPUT RESIDUALS First Half | INPUT RESIDUALS Second Half | CALCULATED RESIDUALS First Half | CALCULATED RESIDUALS Second Half |
|---|---|---|---|---|
| A | S10 (Excitation Signal) | S9 | S9 | S8 |
| | X9 | X8 | — | X9 |
| B | S8 | S7 | S7 | S6 |
| | X7 | X6 | X8 | X7 |
| C | S6 | S5 | S5 | S4 |
| | X5 | X4 | X6 | X5 |
| D | S4 | S3 | S3 | S2 |
| | X3 | X2 | X4 | X3 |
| E | S2 | S1 | S1 | So (Xo) output |
| | S1 | Xo | X2 | X1 |

A 16 bit circulating shift register 83 is used to store the filter weight pair for that stage. At the beginning of the first half cycle, the even numbered weight occupying the lower 8 bit positions of shift register 83 is loaded in parallel into multipliers 84 and 85. The even number weight is then circulated 8-bit positions so that the odd weight occupies the lower half of shift register 83. In a sample period corresponding to an update period, the updated weights replace the old weights during the shift operation with correct timing of selector 86.

Functionally, the backward residual XN-1 serially multiplies the weight WK in multiplier 84 and the resulting product is added serially in adder 87 to the forward residual SN resulting in the updated value of the residual SN-1. The forward residual is delayed by 8-bits in delay circuit 88 to compensate for the delay through the multiplier 84. In addition, they newly calculated residual multiplies the weight in multiplier 85. The resulting product is subtracted from the backward residual in subtractor 89, resulting in an update value for the residual KN. The input to subtractor 89 from selector 82 is delayed by 16-bits in delay circuit 90. Both residuals are delayed by one half sample through the 12-bit holding registers 91 and 92.

Figure 13:
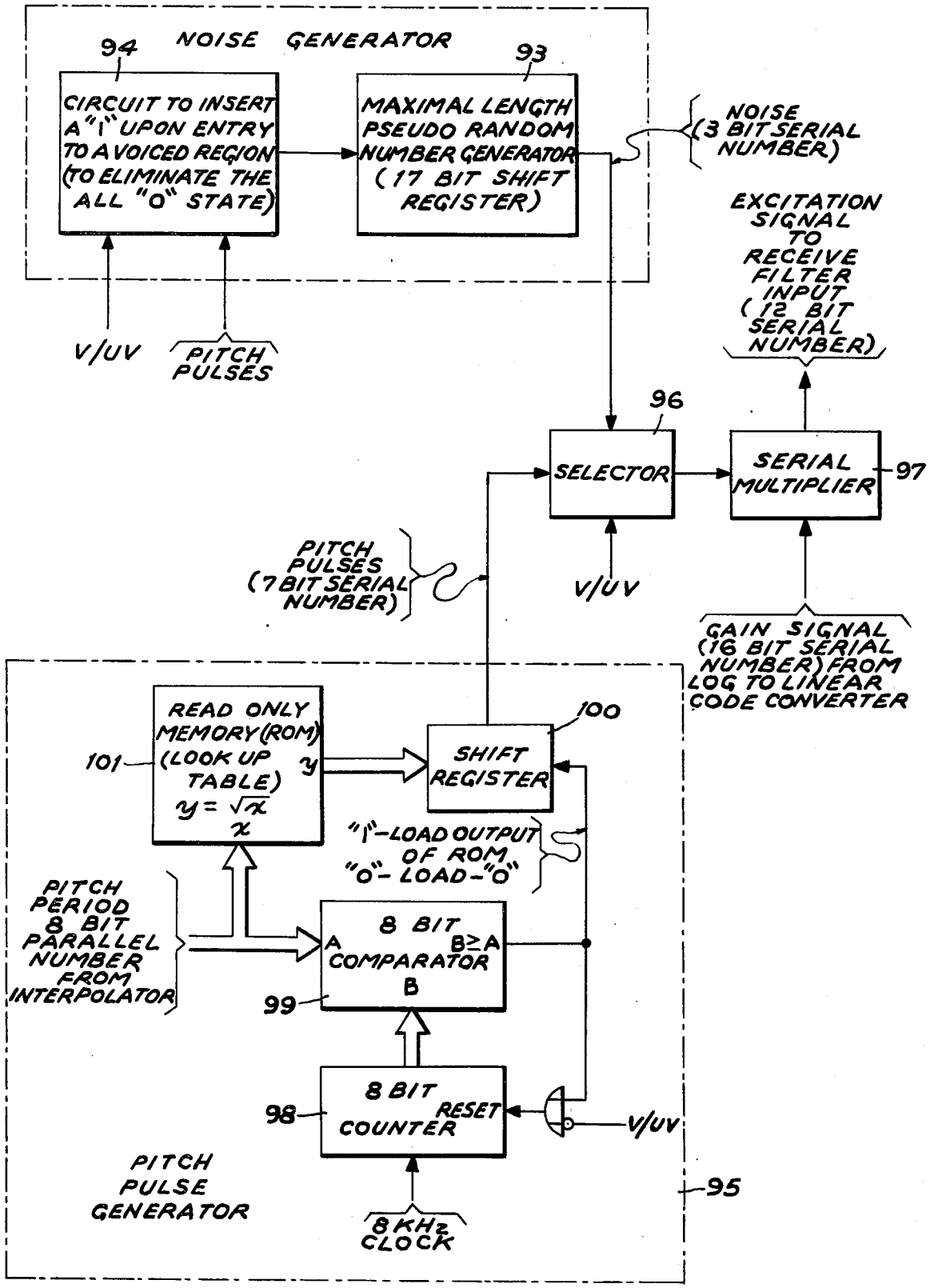
FIG. 13 is a block diagram of the excitation signal generator of FIG. 11.

Referring to FIG. 13, there is disclosed therein a block diagram of the excitation signal generator of FIG. 11. The purpose of the excitation signal generator is to provide an excitation signal to the input of the adaptive receive filter. During voiced segments of speech, the excitation is a pulse train whose period is determined by the pitch period parameter from the transmitter. During unvoiced segments, the excitation signal is pseudo random, uniformly distributed noise. During either part, the amplitude of the excitation is determined by the residual power parameter or gain signal.

In an unvoiced part of speech, and up to the first pitch pulse in a voiced part, the output of a 17-bit maximal length pseudo random sequence generator 93 is sampled three times to generate a uniform random 3-bit number X, where $-2 \leq X < 2$ with mean zero and variance one. To ensure that the pseudo random generator will not remain in the 0 state, should it even enter this state, a 1 is inserted in the generator by circuit 94 when the first pulse is generated.

The 17-bit pseudo random shift register was selected so that its repetition rate is low enough, approximately 4 seconds, so as not to produce any audible variation. During voiced parts, the output of the pitch pulse generator 95 is selected by selector 96 and multiplied by the gain in serial multiplier 97.

Pitch pulses are generated as follows. During each 125 microsecond sample interval, a counter 98 is incremented and compared in comparator 99 to the pitch period input. If the count is greater than or equal to the input, the generator produces a 1 at the output of comparator 99 and the counter 98 is reset.

If the count is less than or equal to the input, counter 98 is incremented and a 0 is the output. The resulting 0 or 1 is multiplied by the period pitch in shift register 100 which has been calculated by using a read-only memory 101 as a look-up table.

To summarize, the excitation generator receives the following parameters as inputs. The gain as a 16-bit serial number, the pitch period as a 8-bit parallel number, and the voicing decision as a 1-bit number. The output is the excitation signal represented as a 12-bit serial word and is an input to the receive filter.

Referring to FIG. 14, there is disclosed therein the parameter interpolator circuit 77 of FIG. 11. At a transmission rate of 3600 bits per second, a new set of parameters is received by the interpolator every 20 milliseconds, at 2400 bits per second every 30 milliseconds and at 4800 bits per second every 15 milliseconds. An output is provided to the receive circuits every 5 milliseconds, 7.5 or 3.75 milliseconds. The function of the interpolator circuit is to calculate the intermediate values for three new sets of parameters in addition to the set that is transmitted.

The present and previous values of the transmitted parameters are stored in two 96-bit shift registers 102 and 103, respectively, 8 bits × 12 parameters, which recirculate the data 4 times. The difference between the present and previous values of each parameter is calculated in subtractor 104 and is divided by four in divider 105. This difference is then added in serial adder 106 to the previous interpolated output through means of delay circuit 107 to produce the present interpolated output. Selector 108 selects the previous value of the parameter during the fourth interval which is applied to circuit 107 and converter 109 to provide a signed magnitude representation of the weighting coefficients for transmission to the receive filter through shift register 110.

At the beginning of each update interval, every fourth set of interpolated parameters, the interpolated parameters are set exactly equal to the previously transmitted parameters. This is done in selector 108 and prevents the accumulation of interpolation errors.

Figure 15:
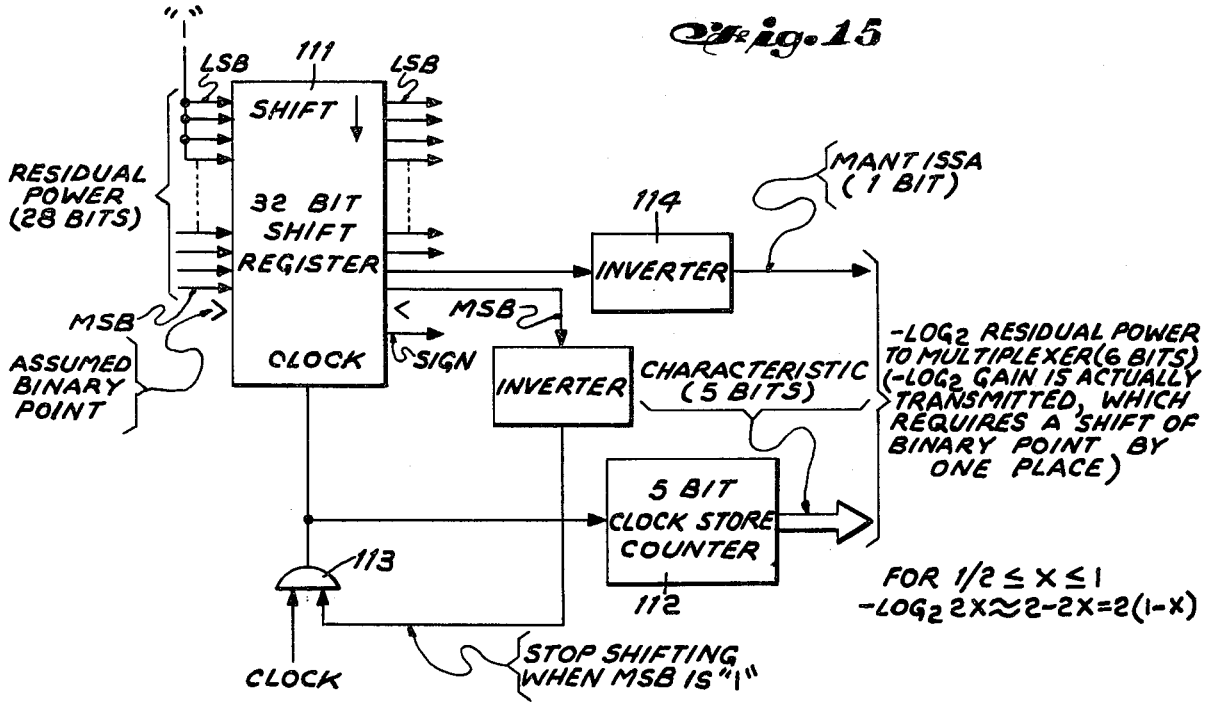
FIG. 15 is a block diagram of the linear to log code converter of FIG. 3.

Referring to FIG. 15, there is illustrated therein the linear to log code converter 22 of the transmitter of FIG. 3. To transmit the residual power signal, it has been found that a 28-bit number is necessary due to the large dynamic range of this parameter. Rather than transmit this many bits, it was decided to transmit a logarithmic representation. A convenient way to calculate $-\log_2 X$ was found which requires only a few simple operations and is accurate to a few percent.

At the transmitter, the residual power is represented as a 28-bit linear fractional number between 0 and +1. This number is loaded into a 32-bit shift register 111 and the four least significant bits are set to 1. The number is shifted toward the most significant digit, that is, multiplied by two until the most significant bit is 1. The number of shifts required is counted in counter 112 where the shifting is under control of AND gate 113. The contents of counter 112 when the shifting is stopped is the characteristic of the logorithm and is a 5-bit number. To calculate the mantissa, the following operations are performed.

The number in the shift register is now between ½ and 1. As indicated by the equation shown in FIG. 15, the log of 2X is equivalent to 1's complementing X and multiplying by 2, or inverting all bits and shifting left once. The inversion takes place in inverter 114. It has been found that 5-bit characteristic and 1-bit mantissa were sufficient to represent the residual power parameter. Before transmission the binary point is shifted to the left, that is, divided by two, to represent the square root of the residual. This 6-bit number is the $-\log_2$ gain which is transmitted to the receive circuits.

Figure 16:
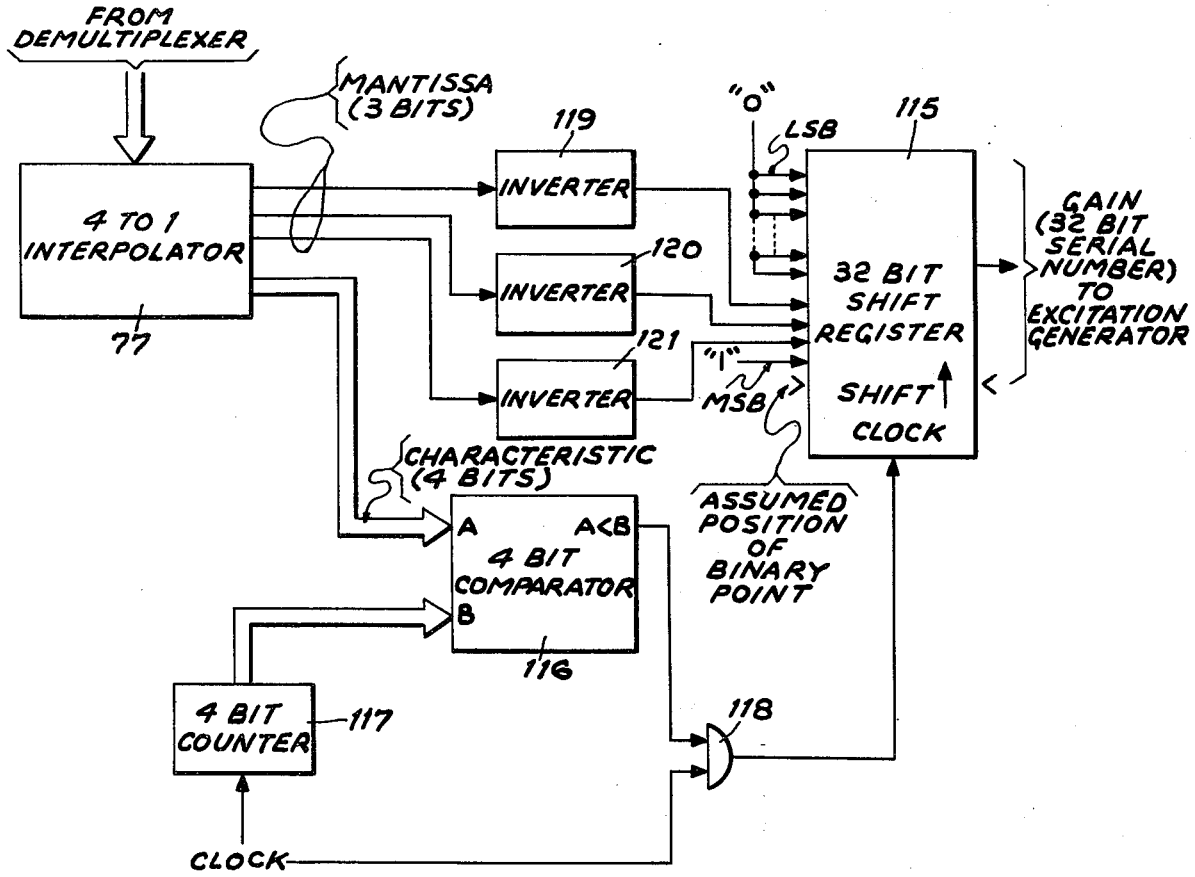
FIG. 16 is a block diagram of the log to linear code converter of FIG. 11.

Referring to FIG. 16, there is illustrated therein the log to linear code converter 80 of FIG. 11 which after linear interpolation of the gain signal in interpolator 77 employs shift register 115, comparator 116, counter 117, AND gate 118 and inverters 119 to 121 to provide an inverse operation to convert the log representation of the gain back to a linear fractional representation of the gain. The resulting 16-bit number is provided as an input to the excitation generator.

In certain of the foregoing drawing Figures making up the multi-processing approach of the vocoder of this invention, there are many arithmetic units operating simultaneously. Each one of them does only that for which it was designed. As a consequence, they can be quite simple. The input and output words for these units are hardwired instead of the flexible instruction read-only-memory in the central processing approach. Shift register memories are used to store variable data.

The advantages of this approach are fourfold: (1) The simple requirements can be satisfied by serial arithmetic and linear representation, (2) relatively few calculations are required, so that the clock rate can be one megahertz or less, (3) despite the greater number of circuits involved, many are repetitive and lend themselves to large scale integration devices, and (4) the latter results in lower power dissipation, smaller size, and lighter weight.

The disadvantages are two: (1) the design is not flexible; it cannot be easily modified, and (2) there is a high initial development cost for the various circuits.

The multi-processor approach was picked for the vocoder of the present invention because of the size, weight, and power advantages; because it can be implemented with metal oxide semiconductors in large scale integrated packages, which offer high quantity production at a low cost; and particularly because the ten stages of the Itakura cascade structure are identical.

To implement this multi-processor approach there are three basic circuit units in the system. They are the serial adder subtractors, the multipliers, and the shift registers.

Referring to FIG. 17, there is disclosed therein a block diagram of the serial adder-subtractor circuit building block. The adder consists of a full adder 122 and a D-type flip-flop 123 to delay the carry output for one clock interval. The calculation is done in 2's complement arithmetic. The corresponding bits of the two numbers which are to be added are entered serially, least significant bit first, into the full adder inputs and the sum occurs serially at the output. The subtract two numbers, the subtrahend is 2's complemented in 2's complementer 124 and is added to the minuend. The 2's complement of a number is obtained by inverting, that is, complementing all bits subsequent to the reception of the first 1 bit. A 2's complement to signed magnitude format converter can be implemented by 2's complementing negative numbers and retaining the 1 sign bit. The subtractor circuit can also be used to compare the size of two numbers and obtain a "less than" or "greater than" decision. The two numbers are subtracted from one another and the sign of the difference indicates which one is the larger.

Figure 18:
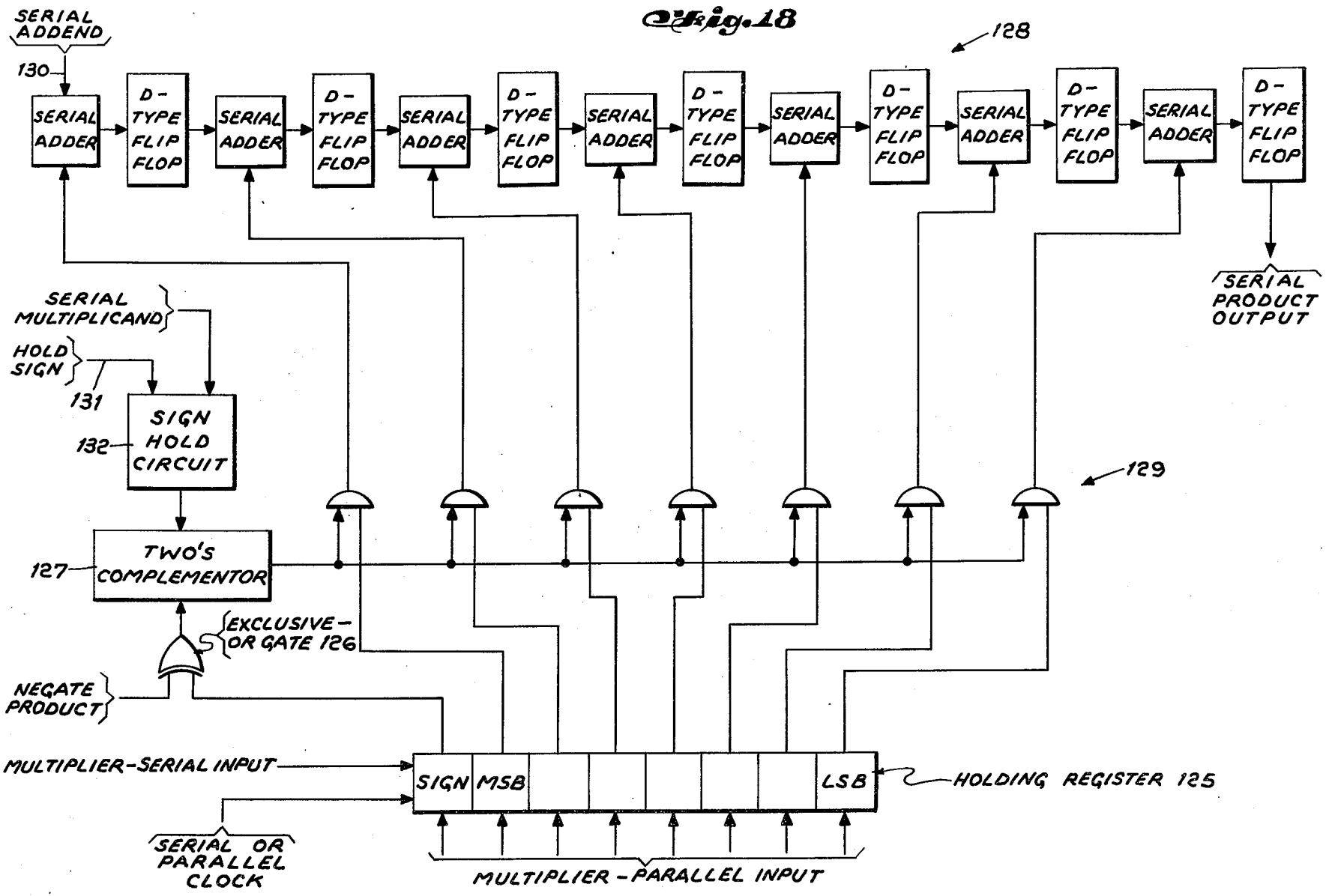
FIG. 18 is a block diagram of a multiplier which is another building block employed in the foregoing figures of the drawing.

Referring to FIG. 18, there is disclosed therein a block diagram of the multiplier circuit employed in the present invention.

To maintain a constant data rate through all arithmetic units involved in a particular calculation, the multiplier circuit should provide a serial output at the same data rate as the input signal as does the serial adder circuit of FIG. 17. The multiplier should also operate at a clock rate less than 1.0 megahertz.

The circuitry for a totally serial multiplier design is very simple but is also very slow and does not produce an output at the same data rate as the input. To produce equal input and output data rates, the system clock rate would have to be greatly increased by over an order of magnitude and would be incompatible with the metal oxide semiconductor large scale integration implementation. A totally parallel multiplier could operate at very low clock rates but its circuit complexity would be prohibitive.

It has been found that the particular configuration of FIG. 18, which is neither a true parallel nor a true serial multiplier is the best compromise. FIG. 18 is a $m \times n$ multiplier circuit where the number of bits in the multiplier word $m$ is equal to 8. Functionally, the eight bit multiplier word (in signed magnitude representation) is read into a holding register 125 either serially or in parallel as required. The multiplicand data word in 2's complement representation is then fed in serially, least significant bit first. The sign of the stored multiplier word determines whether or not to invert the multiplicand in order to control the sign of the product. This is accomplished in EXCLUSIVE-OR gate 126 and 2's complementor 127. Each time a 1 is received in the multiplicand, the multiplier word is added to the contents of a shifting accumulator 128 made up of stages of serial adders as illustrated in FIG. 17 and D-type flip-flops. The AND gates 129 control the adding of the multiplier word to the contents of the shift accumulator 128. The output product is the sequence of bits obtained from the last stage of the shifting accumulator 128. No limit exists as to the length of the multiplicand, but its sign must be stretched to at least 7 bits for $m = 8$. Provision has been made to feed in a third word in 2's complement format which will be added to the product of the other two. A control input signal at input 131 to hold circuit 132 is provided to invert the output product. The result is fed out serially from the last stage of accumulator 128 with a single bit delay. Multiplication is thus carried out at a clock rate equal to that of the incoming rate.

As mentioned the third circuit is a normal shift register including serial in and serial out shift registers which are used for data memory wherever possible. Shift register memory is feasible because of the serial inputs and output of the serial arithmetic units and because they are easily implemented using metal oxide semiconductor large scale integrated circuit techniques.

It has been found that the multi-processing approach requiring the three basic building blocks; namely, the shift registers, the adders and subtractors of FIG. 17, and the multiplier of FIG. 18 can be easily employed using RCA's series 4000 CMOS logic family. The two most useful devices in this family are the CD4032 "triple serial adder" and the CD4006 "18 bit shift register ". The CD4032 can be used to directly implement the serial adder shown in FIG. 17 and can implement the full adders and carry delays for three stages of the shifting accumulator in the multiplier circuit of FIG. 18. The CD4006 can be used to form 16 and 32 bit serial memory registers employed throughout the vocoder system.

Referring to FIG. 2, squarer and low pass filter 18 basically includes a squarer which multiplies the prediction residual at the output of filter 17 by itself and may take the form of the multiplier described with respect to FIG. 18 where the multiplicand and multiplier are both the prediction residual. The output of the squarer is a 32-bit integer which is coupled to a low pass filter which is digital in nature and will be described hereinbelow with respect to FIG. 19. The low pass filter obtains the frequency and impulse responses of the prediction residual. The output of low pass filter is coupled to pitch period extraction circuit 19 which operates in accordance with the algorithm described hereinbelow and is implemented as described hereinbelow. The output of circuit 19 is the extracted pitch period.

To be consistent with the other circuits of this application the adders and subtractors employed in connection with certain of the decision circuits of circuit 19 are serial arithmetic units as fully disclosed in FIG. 17.

Figures 19, 21:
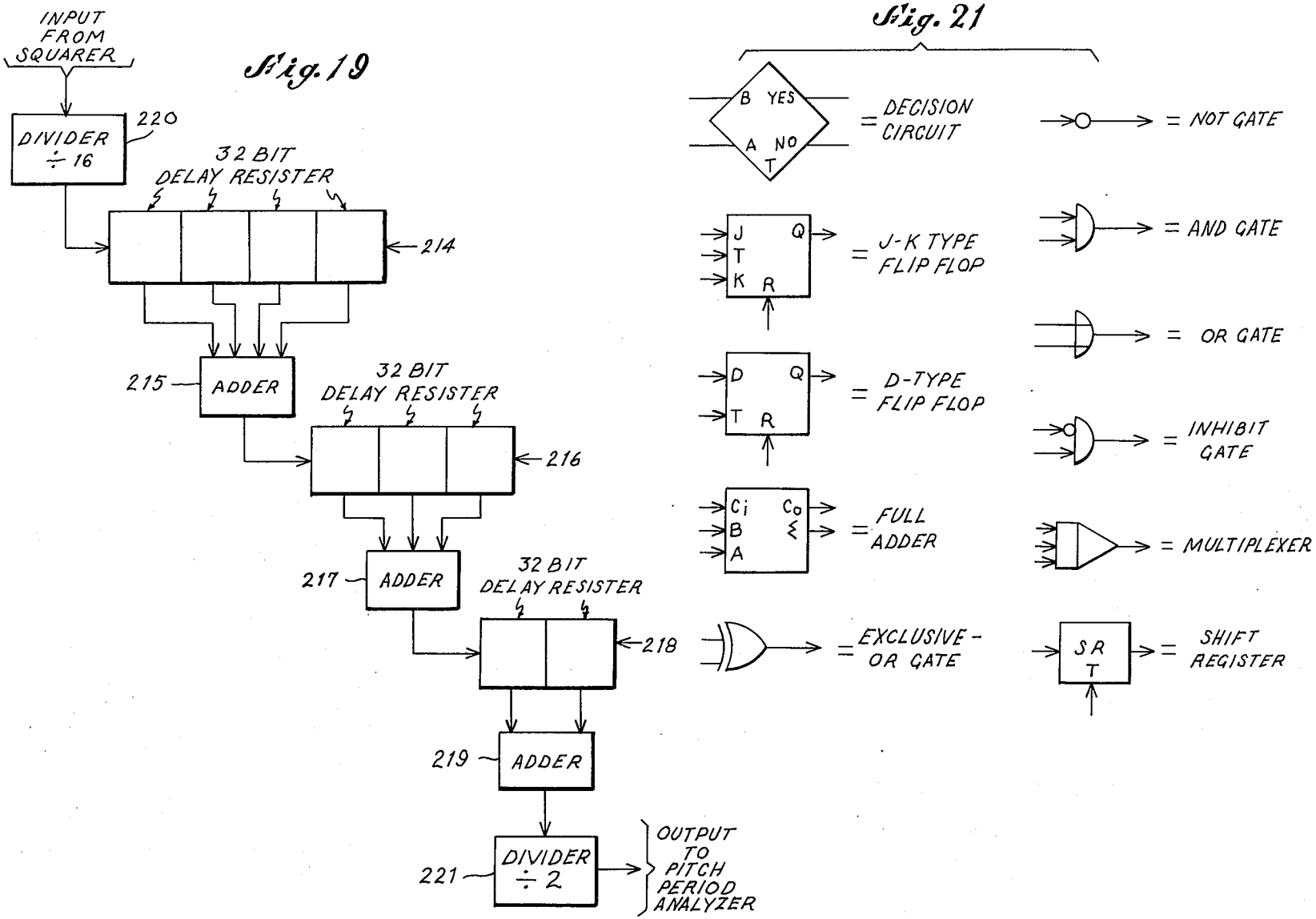
FIG. 19 is a block diagram of the low pass filter of FIG. 2.
FIG. 21 illustrates and defines logic symbols employed in FIGS. 22 and 23.

FIG. 19 illustrates the block diagram of the low pass filter of FIG. 2 and basically includes four 32-bit delay registers 214, an adder 215 coupled to each of the four delay registers 214. The output of adder 215 is coupled to three 32-bit delay registers 216 with each of these registers having their outputs coupled to adder 217. The output of adder 217 is coupled to two 32-bit delay registers 218 whose outputs are coupled to adder 219. The digital low pass filter employed is relatively simple since registers and adders are the only components employed therein. The low pass filter as just described has an effective measured DC (direct current) gain of 24. To avoid overflows in registers 214, 216 and 218, the squared residual from the squarer of FIG. 2 is divided by sixteen in divider 220 prior to application to the first delay registers 214. This reduces the effective number of bits for the squared residual to 28. In addition, the output of the filter, namely, the output of adder 219 is divided by 2 in divider 221 before application to circuit 19 of FIG. 2. As a result, the overall measured DC filter gain is 0.75.

Figure 20A:
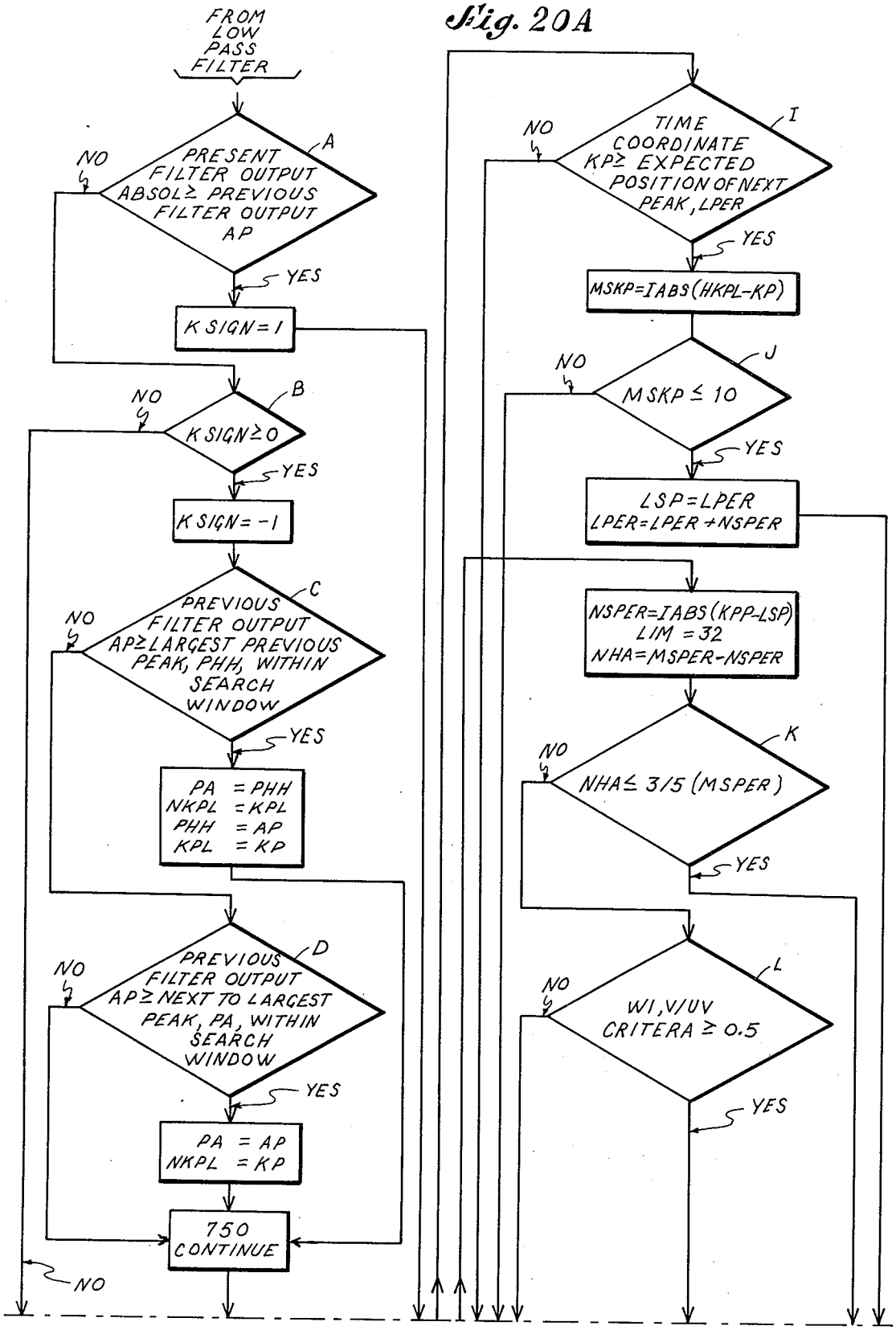
FIGS. 20A and 20B, when organized as illustrated in FIG. 20C, is the flow chart of the pitch period extraction algorithm in accordance with the principles of the present invention.
Figures 20B, 20C:
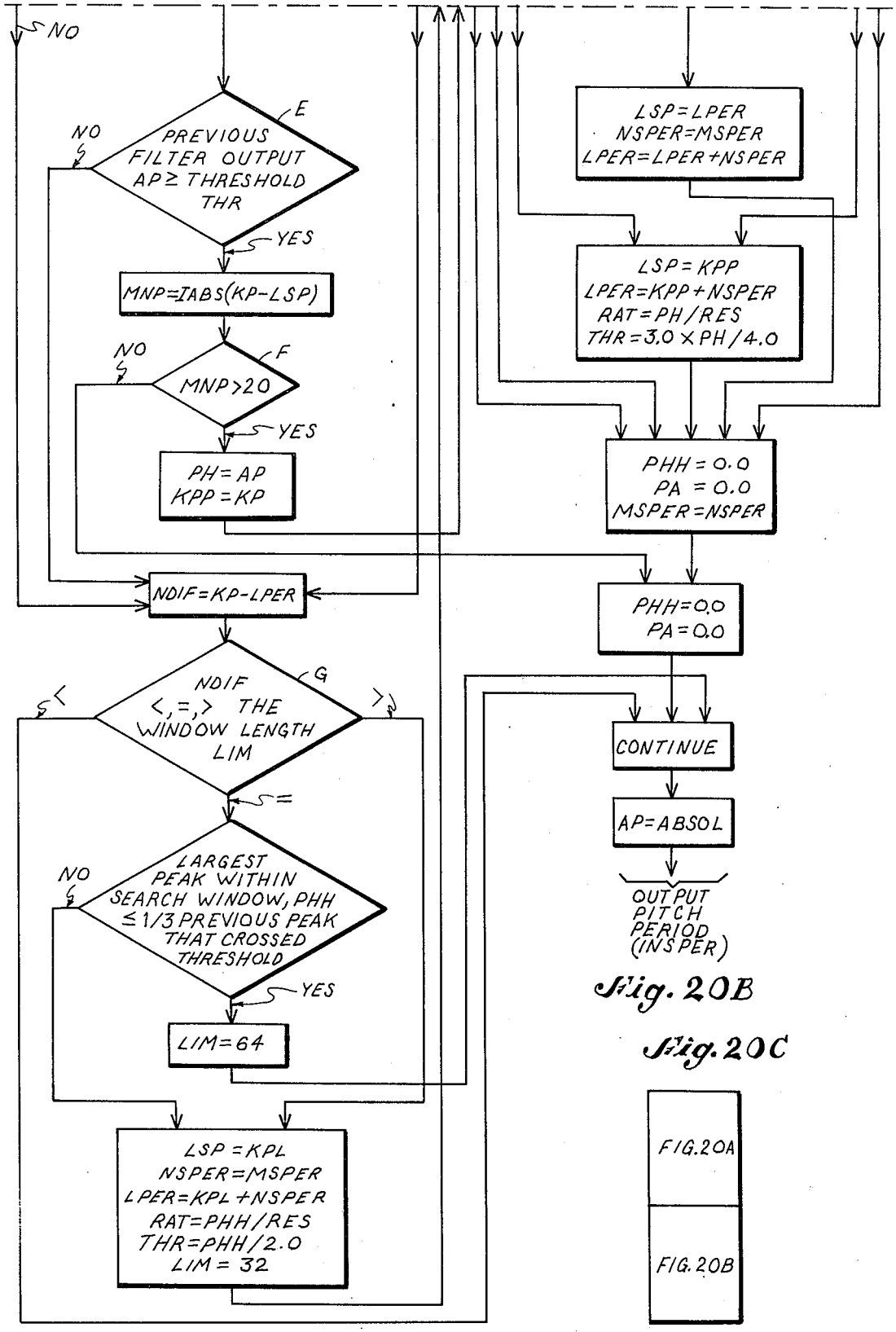

FIGS. 20A and 20B, when organized as illustrated in FIG. 20C, illustrates the flow chart of the pitch period extraction algorithm which when taken with the following Table I of mnemonics will be self-explanatory and easily understood.

TABLE I

| MNEMONIC | MEANING |
|---|---|
| KP | Time Coordinate |
| PA | Next to the highest peak amplitude within search window |
| NKPL | Position of next to the highest peak within search window |
| KPL | Position of largest peak in search window |
| LSP | Position of previous pitch peak |
| PH | Amplitude of latest pitch peak |
| KPP | Position of latest pitch peak |
| LPER | Assumed position of next pitch peak |
| LIM | Window width parameter |
| NSPER | Pitch period |
| MSPER | Previous pitch period |
| PHH | Amplitude of largest peak within the search window |
| ABSOL | Present filter output |
| AP | Previous filter output |
| KSIGN | Was last sample larger or smaller than previous sample |
| MSKP | IABS(NKPL-KP) |
| IABS | NSPER/(KPP-LSP) |
| NHA | MSPER-NSPER |
| THR | Threshold |
| MNP | IABS(KP-LSP) |
| NDIFF | KP-LPER |
| RAT | PH/RES |
| RES | Power of Prediction Residual |
| NUMRAT | Input to V/UV Decision Circuit |
| IPRP | Input to Pitch Corrections Circuit (Pitch Period from two samples ago) |
| INRP | Input to pitch correction circuit (pitch period from previous sample) |
| STUFF 1 | Stuff sign bits ("0") in MSB |
| STUFF 2 | Stuff two sign bits ("0") in MSB |

The above mnemonic table will also be helpful in following the operation of the logic diagram of FIGS. 23A–23J it being noted, however, that a prefix D before any of the above mnemonic means "connected to decision circuits".

Figures 22, 23K:
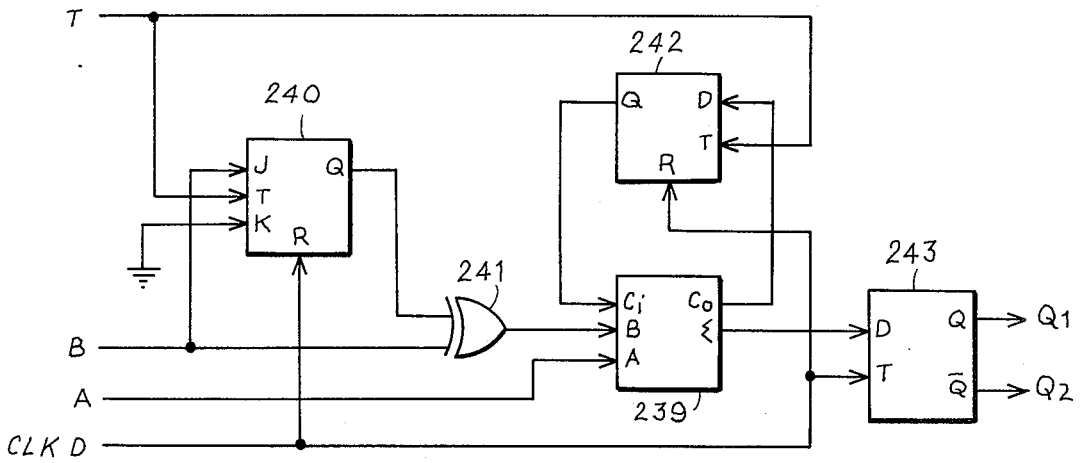
FIG. 22 is a logic diagram of a decision circuit as employed in FIG. 23.

Referring to FIG. 22, there is illustrated therein the logic circuitry of a decison circuit that will be employed in the logic diagram of FIGS. 23A–23J implementing the pitch period extraction algorithm. Each of the decision circuits includes inputs A and B coupled to full adder 239, JK flip-flop 240, and EXCLUSIVE-OR gate 241. The full adder has added thereto a D-type flip-flop 242 to provide a serial adder as illustrated in FIG. 17. The sum output of full adder 239 is coupled to D-type flip-flop 243.

The truth table for this decision circuit is shown hereinbelow in Table II.

TABLE II

| FUNCTION | Q1 | Q2 |
|---|---|---|
| B>A | Yes | No |
| B ≤ A | No | Yes |

Referring to FIGS. 23A–23J, when organized as indicated in FIG. 23K, there is disclosed therein the logic diagram that implements the pitch period extraction algorithm for circuit 19 of FIG. 2. The logic diagram includes multiplexers 244–255 associated with shift refisters 256–262 and 265–269, as illustrated in FIGS. 23A–23E. The shift registers perform a dual function. They provide a means for storing the variables and also provide a one sample delay during which the decisions are made. As will be noted, the multiplexers 244–255 have signals applied to their widest side of the rectangular portion of the multiplexer symbol. These are the signal inputs to the multiplexers from various ones of the shift registers 256–262 and 265–269 together with constant values. A select signal or signals are applied to the narrow edge of the rectangular portion of the multiplexer symbols of certain of the multiplexers to select the signals applied to the wide side thereof in accordance with the selecting code illustrated in the rectangular portion of the multiplexer symbol for the coupling of input signals to the shift registers associated therewith and also to the decision circuits which are illustrated in FIGS. 23F–23I. The selecting signals for the multiplexers are derived from the decisions of the decision circuits by the flow logic shown in FIG. 23J, the outputs of which are applied directly or through intermediate gating circuits to the various selecting signal inputs of the multiplexers having selecting inputs.

With the correct data ready to enter each of the registers 256–262 and 265–269, the data is clocked into the shift registers while at the same time being clocked through the decision circuitry. At the end of this cycle, both the input data has been stored in the registers and all the decisions which were set forth in the flow chart have been made. In the idle time following this, the answers from the decisions are transformed through the flow logic of FIG. 23J into the control commands or signal selectors of the multiplexers 244–255. At the start of the next cycle, these multiplexers 244–255 are set to admit the correct new values to the registers 256–262 and 265–269 and the process repeats itself.

Figure 23A:
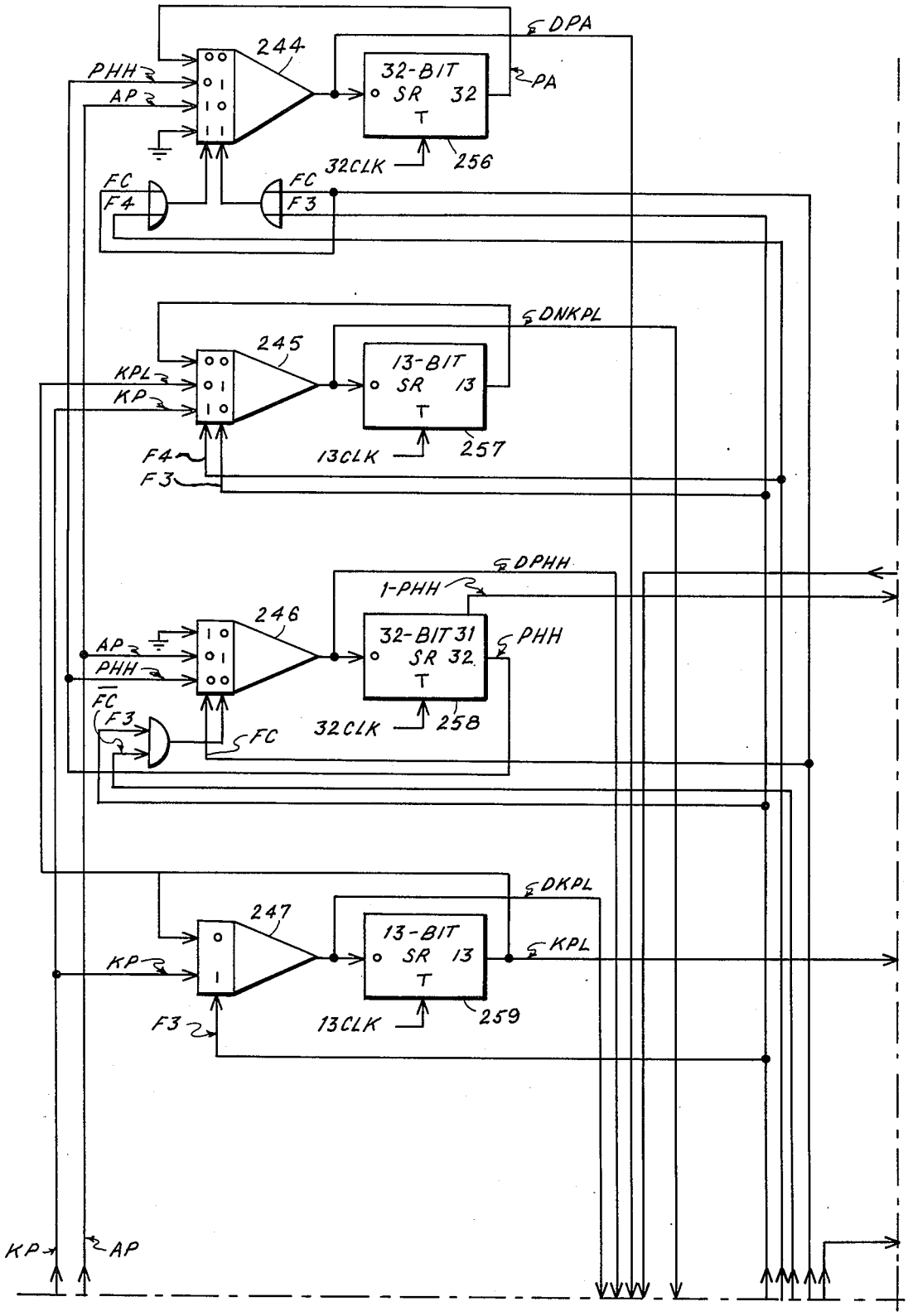
FIGS. 23A through 23J, when organized as illustrated in FIG. 23K, is a logic diagram implementing the algorithm of FIGS. 20A and 20B.
Figure 23B:
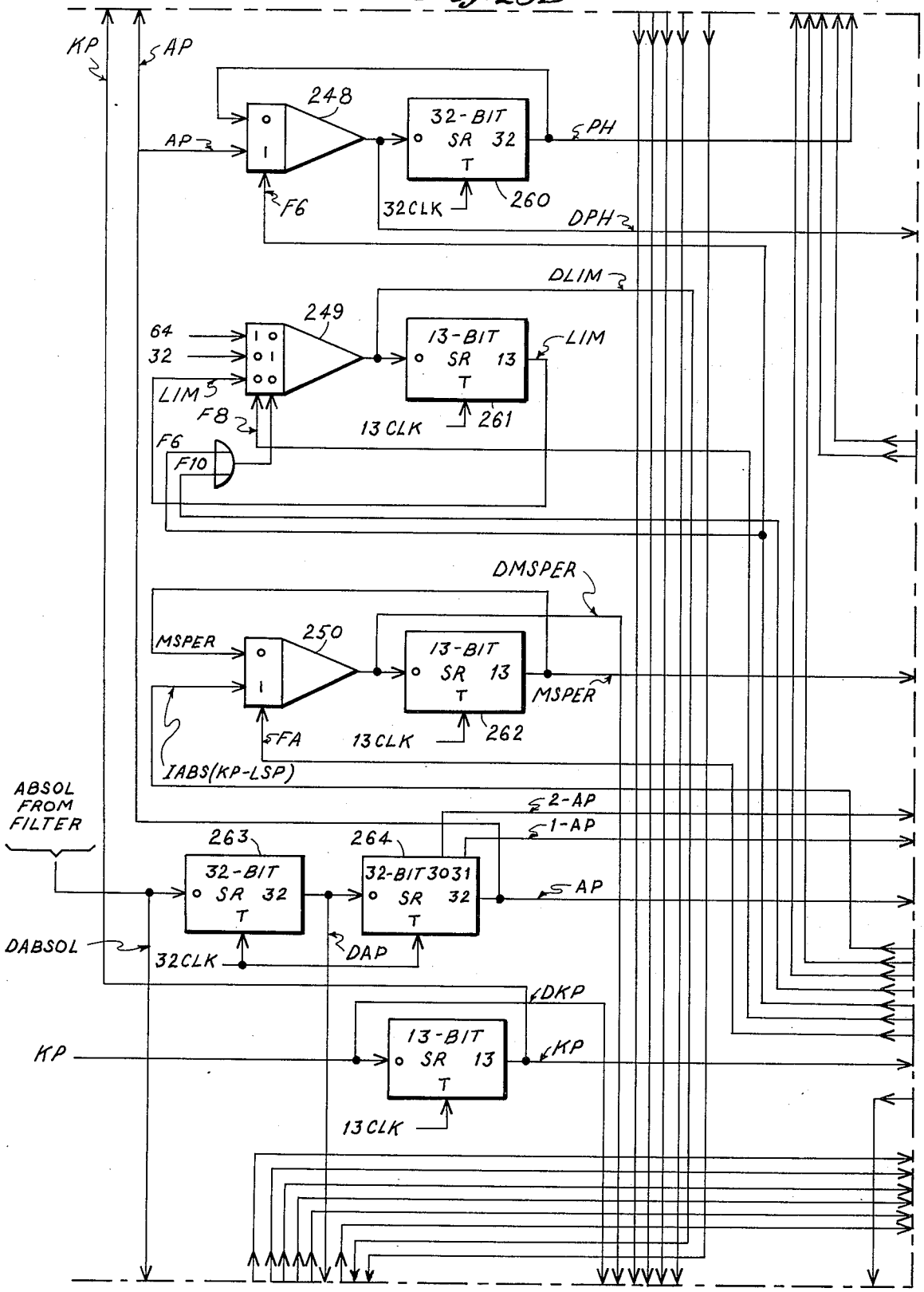
Figure 23C:
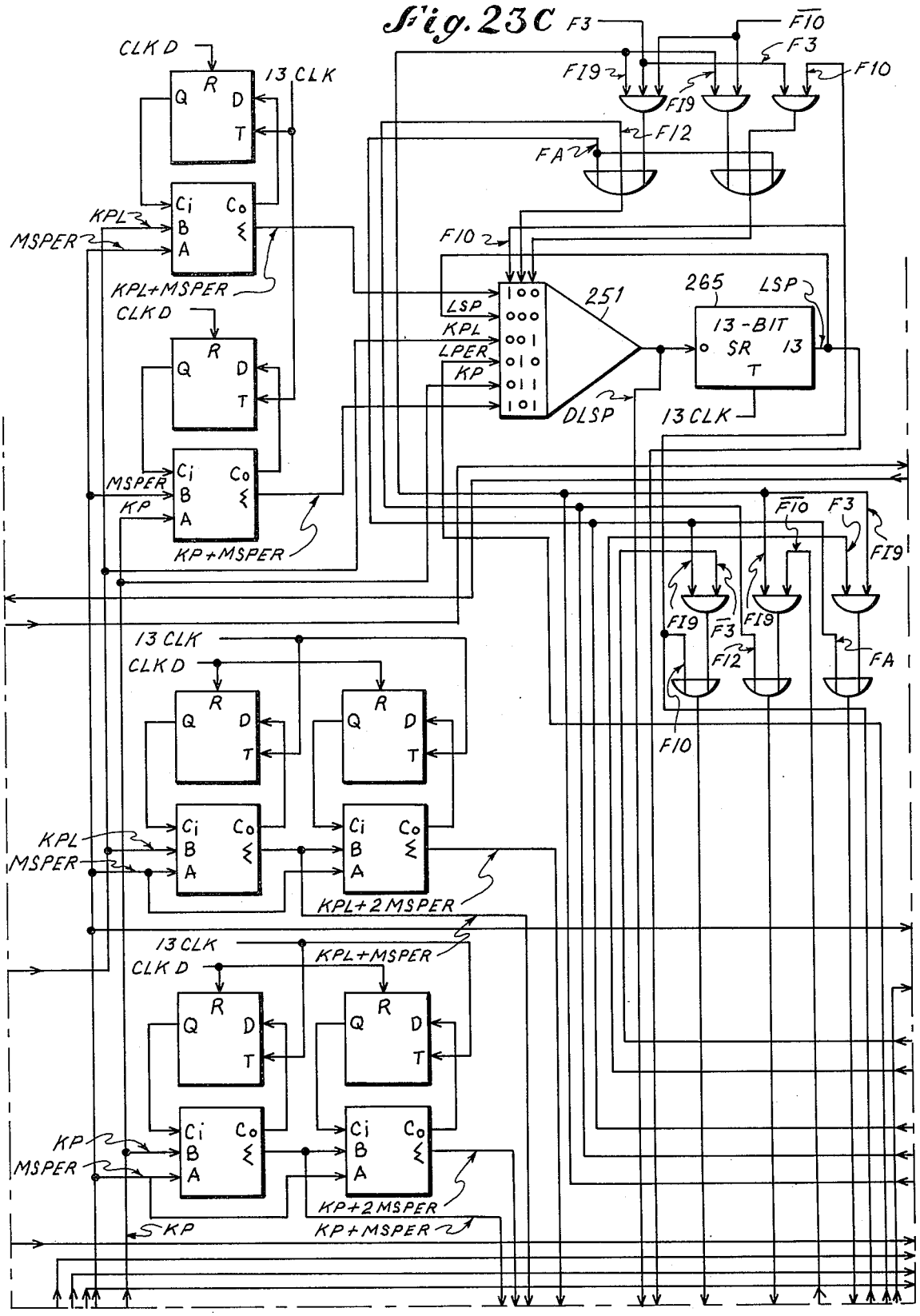
Figure 23D:
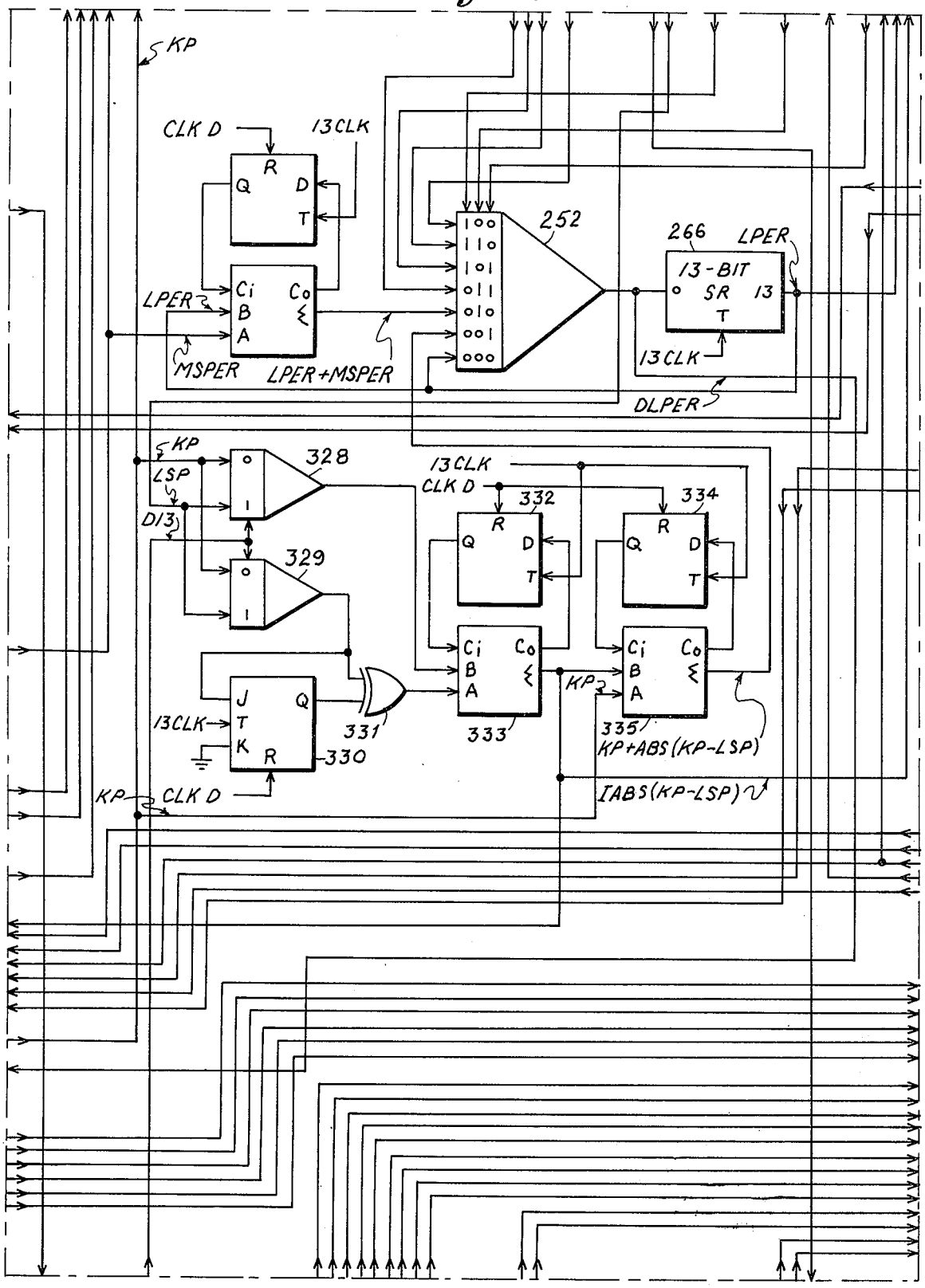
Figure 23E:
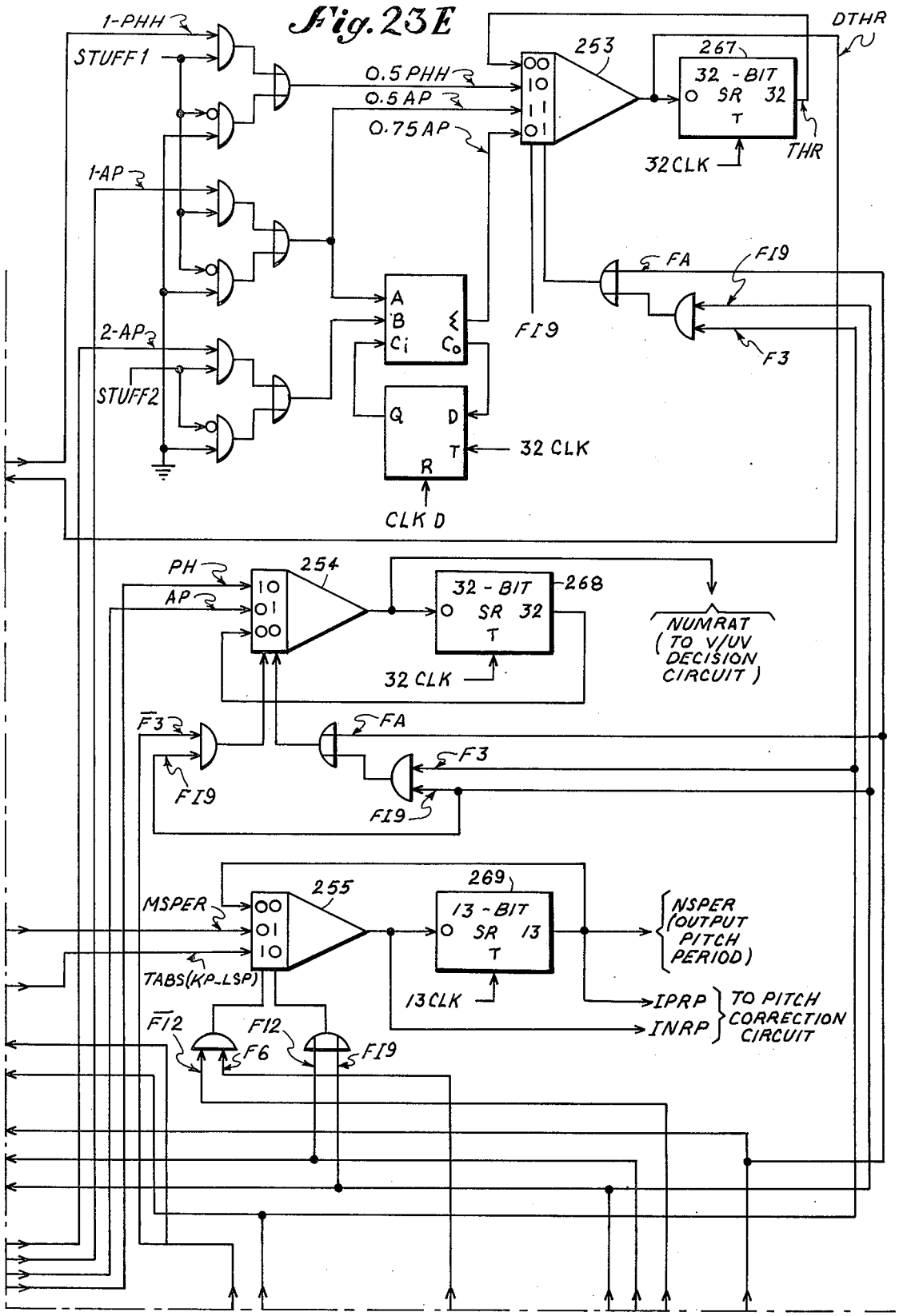
Figure 23F:
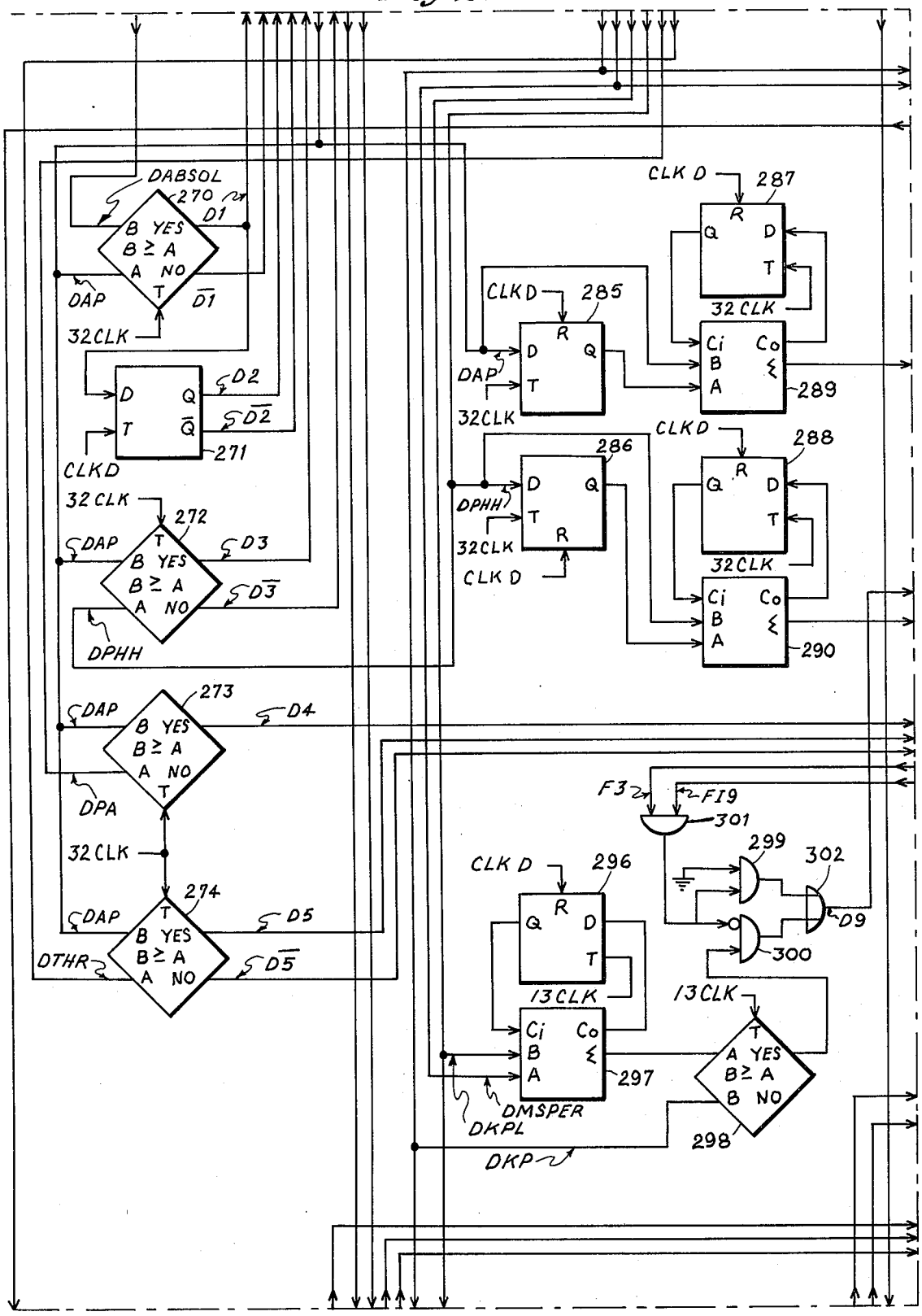
Figure 23G:
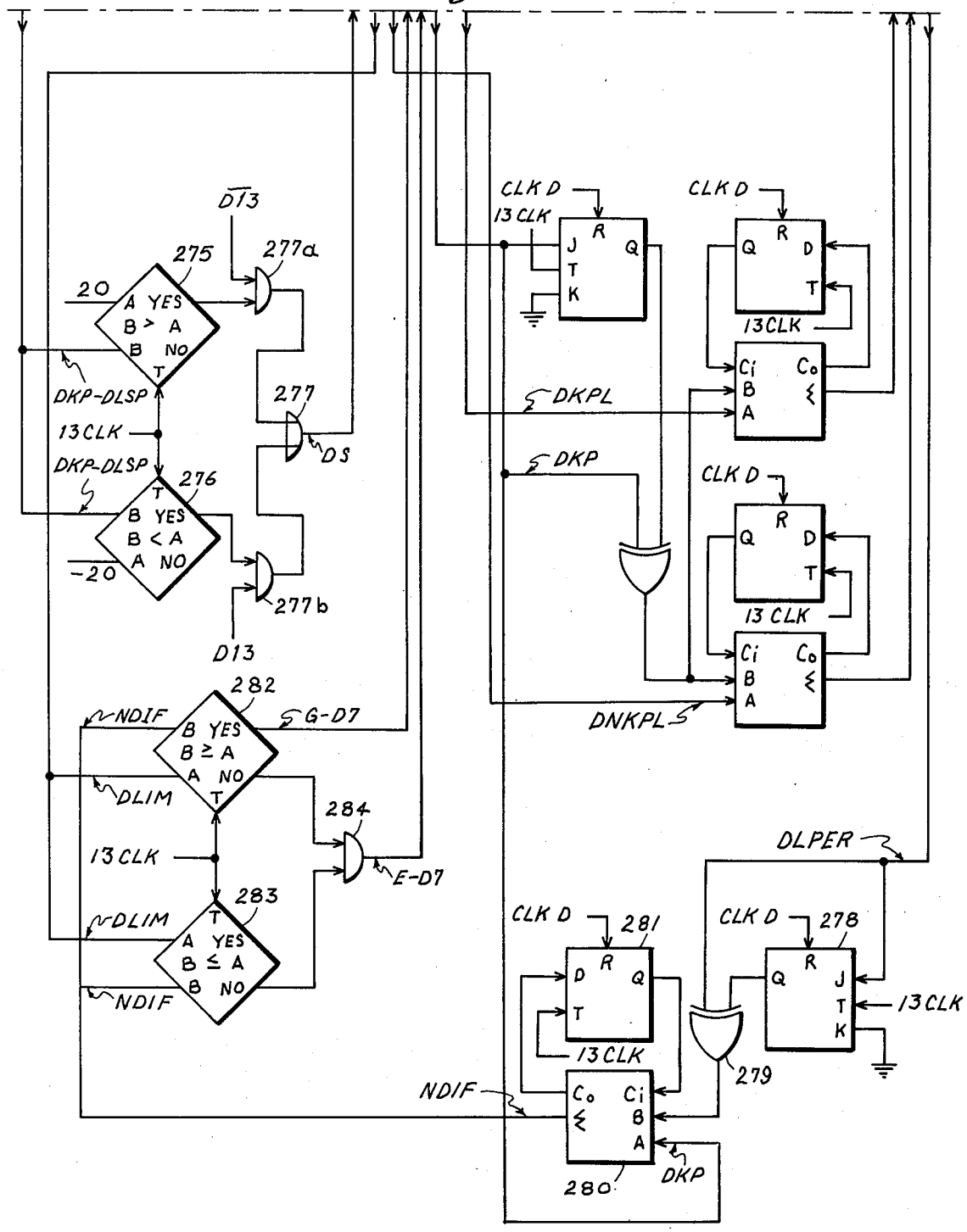
Figure 23H:
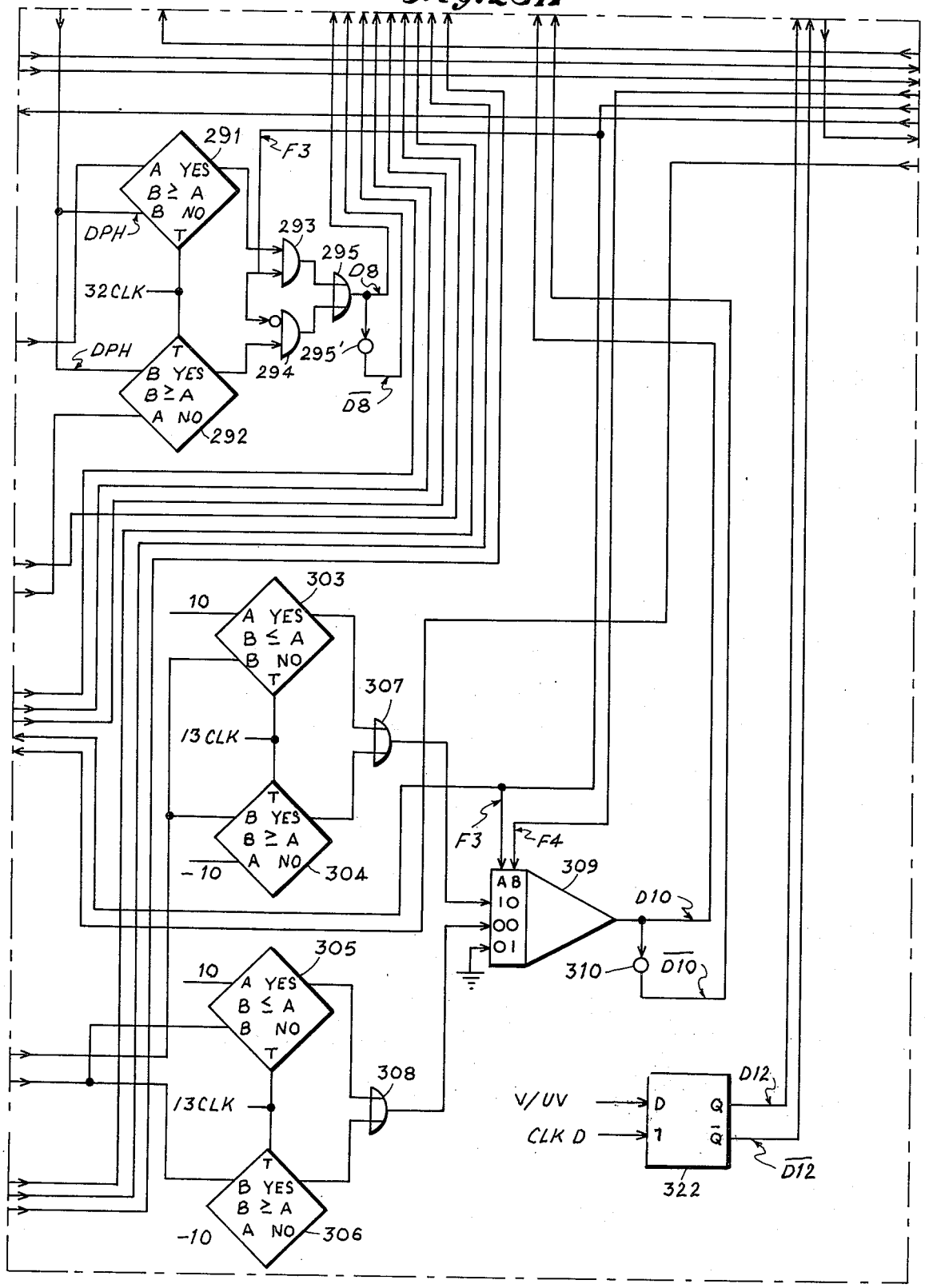
Figure 23I:
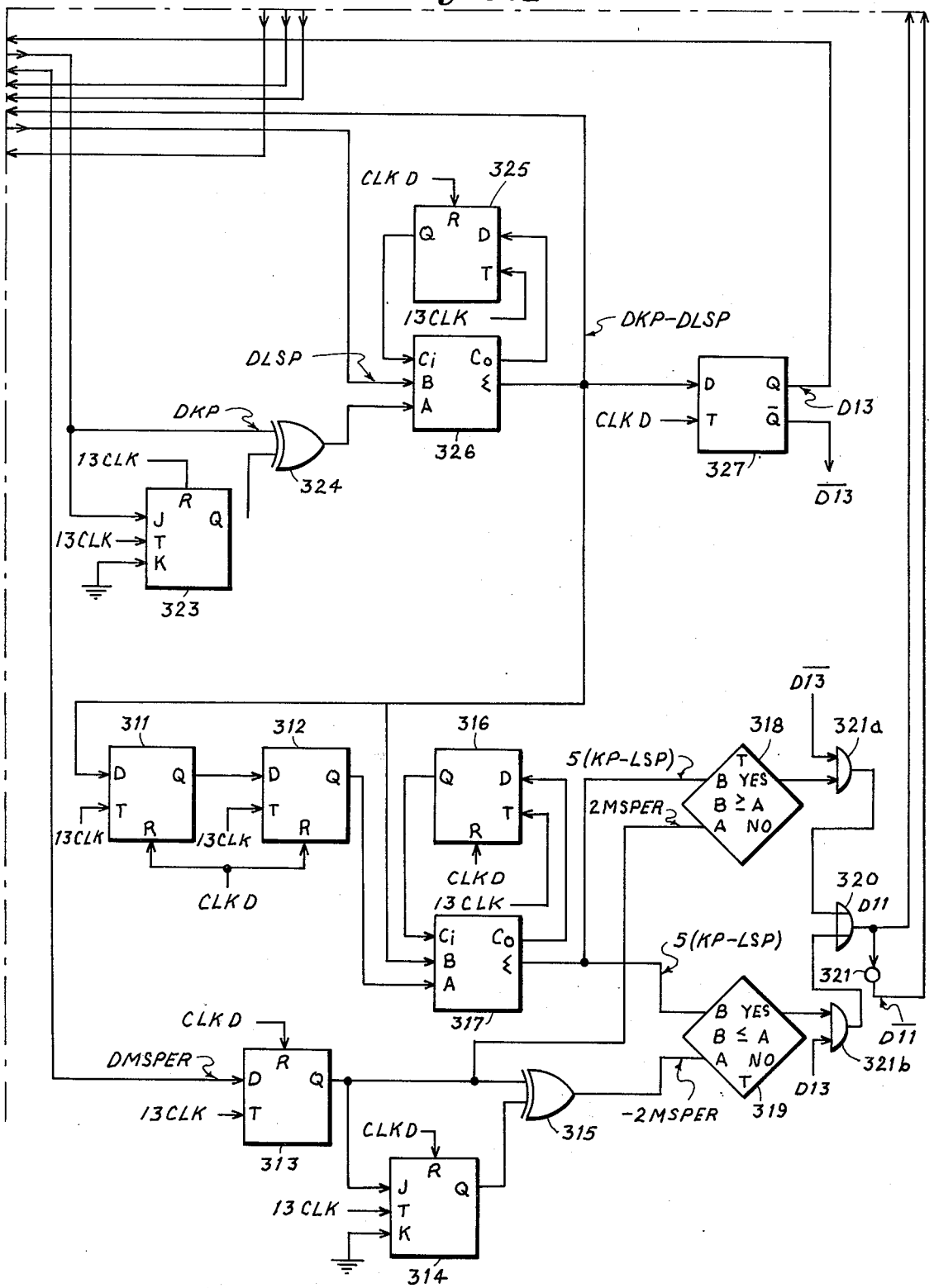

There are only two external inputs to the pitch period extraction circuit. One input is the 1-bit decision from the voicing circuit which appears as input V/UV in FIG. 23H. This input is received every sample from the voicing circuit 21 (FIG. 2). The second input is the partially processed speech information referred to as ABSOL which is the output of squarer and low pass filter 18 (FIG. 2). This signal is illustrated in FIG. 23B and is a 32-bit data word received serially on a sample by sample basis every 125 microseconds. Shift registers 263 and 264 are provided to store the two previous samples. At the same time that the pitch period extraction circuit is receiving the 12th bit of ABSOL, the first bits of signals INRP and IPRP, the pitch period from the previous sample and the pitch period from two samples ago, respectively, are being fed to the pitch correction circuit 20 (FIG. 2) from shift register 269 (FIG. 23E). Both of these signals are 13-bit data words which represent the integer number of samples from one to the next pitch peak and, therefore, the pitch period. A third signal NUMRAT, a 32-bit serial word is also available at the output of multiplexer 254 (FIG. 23E) and is sent to circuit 21 (FIG. 2). As the first bit of ABSOL is being clocked into the pitch period extraction circuit, the first bit of NUMRAT is clocked into the decision circuit 21 (FIG. 2).

The pitch period output NSPER is obtained from shift register 269 (FIG. 23E).

The total time needed to cycle through the decisions is 32 clock periods. Pitch period analysis is carried out during every sample period of 125 microseconds.

The decision circuits illustrated in FIGS. 23F–23I will now be correlated with the decisions contained in the diamond-shaped blocks of the flow chart of FIGS. 20A and 20B.

The decision for the diamond-shaped block A of the flow chart is performed by decision circuit 270 with the D1 decision being coupled to a D-type flip-flop 271 to provide the second decision as indicated in the diamond-shaped block B of the flow chart.

The decision of the diamond-shaped block C of the flow chart is carried out by decision circuit 272.

The decision specified in diamond-shaped block D of the flow chart is performed by decision circuit 273 and the decision set forth in diamond-shaped block E is carried out by decision circuit 274.

The decision specified in diamond-shaped block F of the flow chart is carried out by decision circuits 275 and 276, OR gate 277 and AND gates 277*a* and 277*b*.

The decision set forth in the diamond-shaped block G of the flow chart is carried out by JK flip-flop 278, EXCLUSIVE-OR gate 279, full adder 280, D-type flip-flop 281, decision circuits 282 and 283 and AND gate 284.

The decision set forth in diamond-shaped block H of the flow chart is carried out by D-type flip-flops 285 and 286, serial adders including D-type flip-flops 287 and 288 and full adders 289 and 290, decision circuits 291 and 292, AND gate 293, INHIBIT gate 294, OR gate 295 and NOT gate 295'.

Figure 23J:
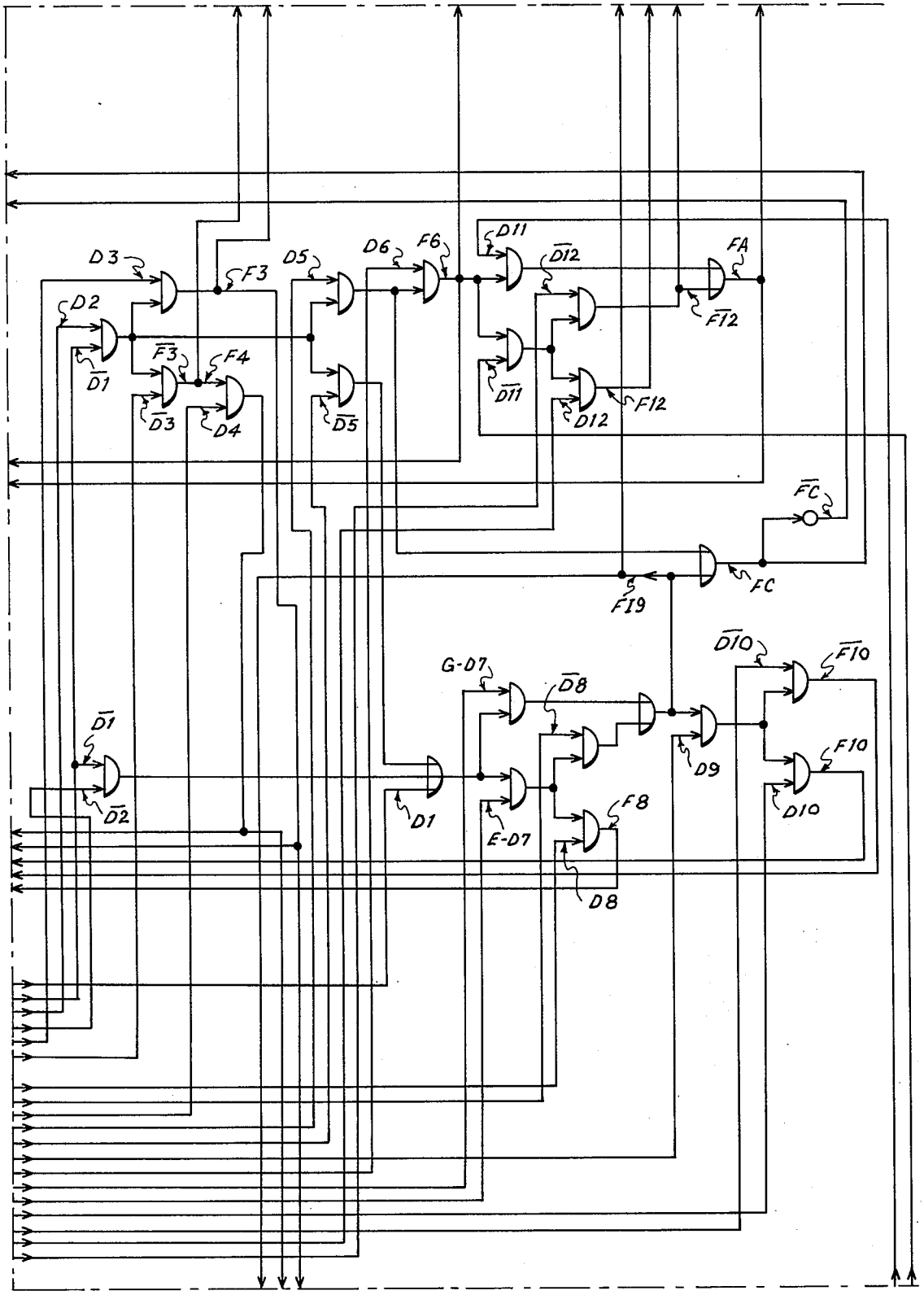

The decision specified in the diamond-shaped block I of the flow chart is carried out by the full adder including D-type flip-flop 296 and full adder 297, decision circuit 298, AND gate 299, INHIBIT gate 300, AND gate 301 receiving inputs from the flow logic of FIG. 23J and OR gate 302.

The decison indicated in the diamond-shaped block J of the flow chart is carried out by decision circuits 303–306, OR gates 307 and 308, multiplexer 309 receiving selection inputs from the flow logic of FIG. 23J and NOT gate 310.

The decision set forth in the diamond-shaped block K of the flow chart is performed by D-type flip-flops 311-313, JK flip-flop 314, EXCLUSIVE-OR gate 315, serial adder including D-type flip-flop 316 and full adder 317, decision circuits 318 and 319l, OR gate 320, NOT gate 321 and AND gates 321*a* and 321*b*.

The decision set forth in the diamond-shaped block L of the flow chart is divided by D-type flip-flop 322 operating on the V/UV input to the pitch period extractor circuit.

A 13th decision identified as D13 is provided by Jk flip-flop 323, EXCLUSIVE-OR gate 324, the serial adder including D-type flip-flop 325, and full adder 326 and D-type flip-flop 327. This decision signal is sent to multiplexers 328 and 329 whose outputs are coupled to JK flip-flop 330, EXCLUSIVE-OR gate 331 and two serial adders, one of which includes D-type flip-flop 332 and full adder 333 and the other of which includes D-type flip-flop 334 and full adder 335. The output of full adder 335 is coupled to one of the signal inputs of multiplexer 252 which provides a DLPER output which cooperates in providing the decision in diamond-shaped block G of the flow chart. Thus, the 13th decision D13 is used to control the production of seventh decision signal G-D7 and E-D7.

While we have described above the principles of our invention in connection with specific apparatus it is to be clearly understood that this description is made only by way of example and not as a limitation to the scope of our invention as set forth in the objects thereof and in the accompanying claims.

We claim:

1. A digital vocoder comprising:

a transmitter including a source of speech, an analog to digital converter coupled to said source to provide a first digital representation of said speech, an adaptive filter coupled to said analog to digital converter to derive from said first digital representation of said speech a digital prediction residual signal and digital spectral parameters, a pitch period extraction circuit coupled to one output of said adaptive filter responsive to said residual signal to produce a first digital excitaion signal representing the pitch period of said speech, a voiced/unvoiced decision circuit coupled to said adaptive filter and said pitch period extraction circuit to produce a second digital excitation signal indicating when said speech is voiced and when said speech is unvoiced, an arrangement coupled to another output of said adaptive filter to produce a digital number representing the gain of said adaptive filter, and a multiplexing and transmitting arrangement coupled to said adaptive filter, said pitch period extraction circuit and said voiced/unvoiced decision circuit to time multiplex and transmit said digital spectral parameters, said first and second digital excitation signals and said digital number; and a receiver including a receiving and demultiplexing arrangement coupled to said multiplexing and transmitting arrangement to receive and separate from each other said digital spectral parameters, said first and second digital excitation signals and said digital number, an excitation generator coupled to said receiving and demultiplexing arrangement responsive to said first and second digital excitation signals and said digital number to produce a third digital excitation signal.

a receive filter coupled to said excitation generator and said receiving and demultiplexing arrangement responsive to said digital spectral parameters and said third excitation signal to provide a second digital representation of said speech which is substantially identical to said first digital representation of said speech, and a digital to analog converter coupled to said receive filter to provide a speech output substantially identical to said speech of said source.

2. A vocoder according to claim 1, wherein said digital spectral parameters are N digital signals each representing a different weighting coefficient of said adaptive filter, where N is an integer greater than 1.

3. A vocoder according to claim 2, wherein said adaptive filter includes N stages of an Itakura type cascade.

4. A vocoder according to claim 3, wherein each of said stages includes a residual calculator providing a forward residual output and a backward residual output, and a correlation calculator coupled to the input of said residual calculator to operate on said forward and backward residual outputs of the previous one of said residual calculators; and a divide circuit having inputs coupled to the outputs of said correlation calculator and an output coupled to said residual calculator and said divide circuit provides said weighting coefficient.

5. A vocoder according to claim 4, wherein each of said residual calculators, each of said correlation calculators and said divide circuits include a repetitive serial arithmetic logic units.

6. A vocoder according to claim 5, wherein said receive filter includes

N/2 logic stages connected in cascade with respect to each other and said third excitation signal with a first feedback arrangement between adjacent ones of said stages and a pair of feedback arrangement in each of said stages, each of said N/2 logic stages being coupled to said receiving and demultiplexing arrangement to operate on a different adjacent pair of said N weighting coefficients on a time sharing basis to provide said second digital representation of said speech.

7. A vocoder according to claim 6, wherein each of said N/2 logic stages include repetitive serial arithmetic logic units.

8. A vocoder according to claim 1, wherein said transmitter further includes a linear to log code converter coupled between said arrangement and said multiplexing and transmitting arrangement to convert said digital number to a log code representing said gain; and said receiver further includes a log to linear code converter coupled between said receiving and demultiplexing arrangement and said excitation generator to convert said log code to a linear code representing said gain.

9. A vocoder according to claim 1, further including a pitch period correction circuit coupled to said pitch period extraction circuit and said voiced/unvoiced decision circuit to eliminate any large changes in said pitch period and thereby improve the quality of said speech output of said digital to analog converter.

10. A transmitter for a digital vocoder comprising:

an analog to digital converter coupled to a source of speech to provide a digital representation of said speech;

an adaptive filter coupled to said converter to derive from said digital representation of said speech a digital prediction residual and digital spectral parameters;

a pitch period extraction circuit coupled to one output of said filter responsive to said residual signal to produce a first digital signal representing the pitch period of said speech;

a voiced/unvoiced decision circuit coupled to said filter and said extraction circuit to produce a second digital excitation signal indicating when said speech is voiced and when said speech is unvoiced;

an arrangement coupled to another output of said filter to produce a digital number representing the gain of said adaptive filter; and a multiplexing and transmitting arrangement coupled to said filter, said extraction circuit and said decision circuit to time multiplex and transmit said digital spectral parameters, said first and second digital excitation signals and said digital number.

11. A transmitter according to claim 10, wherein said digital spectral parameters are N digital signals each representing a different weighting coefficient of said filter, where N is an integer greater than 1.

12. A transmitter according to claim 11, wherein said filter includes N stages of an Itakura type cascade.

13. A transmitter according to claim 12, wherein each of said stages include a residual calculator providing a forward residual output and a backward residual output, and a correlation calculator coupled to the input of said residual calculator to operate on said forward and backward residual outputs of the previous one of said residual calculators; and a divide circuit having inputs coupled to the outputs of said correlation calculator and an output coupled to said residual calculator and said divide circuit provides said weighting coefficient.

14. A transmitter according to claim 13, wherein each of said residual calculators, each of said correlation calculators and each of said divide circuits include repetitive serial arithmetic logic units.

15. A transmitter according to claim 10, wherein said transmitter further includes a linear to log code converter coupled between said arrangement and said multiplexing and transmitting arrangement to convert said digital number to a log code representing said gain.

16. A transmitter according to claim 10, further including a pitch period correction circuit coupled to said pitch period extraction circuit and said voiced/unvoiced decision circuit to eliminate any large changes in said pitch period and thereby improve the quality of said speech output of said digital to analog converter.

17. A receiver for a digital vocoder comprising:

a receiving and demultiplexing arrangement to receive a serial digital pulse train containing digital spectral parameters derived in an adaptive filter at a transmitter from input speech, first and second digital excitation signals derived at said transmitter from said adaptive filter and a log coded digital number representing gain in said adaptive filter and to separate the contents of said pulse train;

an excitation generator coupled to said arrangement responsive to said first and second excitation signals and said digital number to produce a third excitation signal;

a receive filter coupled to said generator and said arrangement responsive to said digital spectral parameters and said third excitation signal to provide a digital representation of speech; and a digital to analog converter coupled to said filter to provide a speech output which is substantially identical to said input speech.

18. A receiver according to claim 17, wherein said digital spectral parameters are N digital signals each representing a different weighting coefficient of said adaptive filter, where N is an integer greater than 1.

19. A receiver according to claim 18, wherein said receive filter includes N/2 logic stages connected in cascade with respect to each other and said third excitation signal with a first feedback arrangement between adjacent ones of said stages and a pair of feedback arrangement in each of said stages, each of said N/2 logic stages being coupled to said receiving and demultiplexing arrangement to operate on a different adjacent pair of said N weighting coefficients on a time sharing basis to provide said digital representation of speech.

20. A receiver according to claim 19, wherein each of said N/2 logic stages include repetitive serial arithmetic logic units.

21. A receiver according to claim 20, wherein said receiver filter further includes a log to linear code converter coupled between said arrangement and said generator to convert said digital number to a linear code representing said gain.

22. A receiver according to claim 17, wherein said receiver filter further includes a log to linear code converter coupled between said arrangement and said generator to convert said digital number to a linear code representing said gain.

* * * * *